US011781419B2

(12) United States Patent
Marsala et al.

(10) Patent No.: US 11,781,419 B2
(45) Date of Patent: Oct. 10, 2023

(54) INSTRUMENTED MANDREL FOR COILED TUBING DRILLING

(71) Applicants: Saudi Arabian Oil Company, Dhahran (SA); Openfield Technology, Versailles (FR)

(72) Inventors: Alberto F. Marsala, Dhahran (SA); Eric Donzier, Versailles (FR); Emmanuel Tavernier, Versailles (FR)

(73) Assignees: Saudi Arabian Oil Company, Dhahran (SA); Openfield Technology

( * ) Notice: Subject to any disclaimer, the term of this patent is extended or adjusted under 35 U.S.C. 154(b) by 205 days.

(21) Appl. No.: 17/290,090

(22) PCT Filed: May 26, 2020

(86) PCT No.: PCT/IB2020/000528
§ 371 (c)(1),
(2) Date: Apr. 29, 2021

(87) PCT Pub. No.: WO2021/240195
PCT Pub. Date: Dec. 2, 2021

(65) Prior Publication Data

US 2022/0243534 A1 Aug. 4, 2022

(51) Int. Cl.
*E21B 47/01* (2012.01)
*E21B 47/13* (2012.01)
(Continued)

(52) U.S. Cl.
CPC ..... *E21B 47/01* (2013.01); *E21B 7/04* (2013.01); *E21B 47/04* (2013.01); *E21B 47/07* (2020.05); *E21B 47/13* (2020.05); *E21B 47/18* (2013.01)

(58) Field of Classification Search
CPC . E21B 7/04; E21B 47/01; E21B 47/04; E21B 47/07; E21B 47/18; E21B 47/13
See application file for complete search history.

(56) References Cited

U.S. PATENT DOCUMENTS 3,292,143 A 12/1966 Russell
4,492,865 A * 1/1985 Murphy ..... E21B 47/11 376/160

(Continued)

FOREIGN PATENT DOCUMENTS

CA 2851237 5/2013
CA 2856274 3/2016

(Continued)

OTHER PUBLICATIONS

PCT International Search Report and Written Opinion in International Appln. No. PCT/IB2020/000528, dated Feb. 25, 2021, 18 pages.

(Continued)

*Primary Examiner* — Brad Harcourt
(74) *Attorney, Agent, or Firm* — Fish & Richardson P.C.

(57) ABSTRACT

Methods and system are provided for measuring parameters while drilling a wellbore using a coiled tubing drilling apparatus. An exemplary system includes an instrumented mandrel including a notch in an outer surface of the instrumented mandrel, and an indentation at each end of the notch. A sensor package in the system includes a sensor, a tubular assembly, and a mounting bracket at each end of the tubular assembly. The sensor package is sized to fit in the notch, with each of the mounting brackets fitting in one of the indentations at each end of the knot, and wherein the sensor package is substantially flush with the instrumented mandrel.

31 Claims, 10 Drawing Sheets

(51) Int. Cl.

| | |
|---|---|
| ***E21B 47/07*** | (2012.01) |
| ***E21B 7/04*** | (2006.01) |
| ***E21B 47/04*** | (2012.01) |
| ***E21B 47/18*** | (2012.01) |

(56) References Cited

U.S. PATENT DOCUMENTS 4,676,313 A 6/1987 Rinaldi
5,128,901 A 7/1992 Drumheller
5,151,658 A 9/1992 Muramatsu et al.
5,176,207 A 1/1993 Keller
5,753,812 A 5/1998 Aron
5,854,991 A 12/1998 Gupta et al.
5,876,645 A 3/1999 Johnson
5,877,995 A 3/1999 Thompson
5,886,303 A 3/1999 Rodney
6,026,900 A 2/2000 Keller
6,283,209 B1 9/2001 Keller
6,739,165 B1 5/2004 Strack
6,740,141 B2 5/2004 Espin et al.
7,093,672 B2 8/2006 Seydoux et al.
7,376,517 B2 5/2008 Rickett
7,595,737 B2 9/2009 Fink et al.
7,721,803 B2 5/2010 Huang et al.
7,913,806 B2 3/2011 Pabon
7,937,222 B2 5/2011 Donadille et al.
7,991,555 B2 8/2011 Yang et al.
8,069,913 B2 12/2011 Coste
8,090,538 B2 1/2012 Wilkinson et al.
8,101,907 B2 1/2012 Jacobi et al.
8,168,570 B2 5/2012 Barron et al.
8,215,384 B2 7/2012 Trinh
8,230,918 B2 7/2012 Ameen
8,253,417 B2 8/2012 Pislak et al.
8,269,501 B2 9/2012 Schmidt et al.
8,347,985 B2 1/2013 Bittar
8,424,377 B2 4/2013 Keller
8,627,902 B2 1/2014 Hammer
8,664,586 B2 3/2014 Schmidt
8,680,866 B2 3/2014 Marsala et al.
8,714,246 B2 5/2014 Pop et al.
8,726,983 B2 5/2014 Khan
8,803,077 B2 8/2014 Schmidt
8,812,237 B2 8/2014 Wilt et al.
8,976,625 B2 3/2015 Bilas
8,997,868 B2 4/2015 Nguyen et al.
9,002,649 B2 4/2015 Bittar
9,080,097 B2 7/2015 Gupta et al.
9,128,203 B2 9/2015 Al-Dossary et al.
9,260,957 B2 2/2016 Commarieu et al.
9,274,249 B2 3/2016 Thorne
9,366,099 B2 6/2016 Ly
9,405,033 B2 8/2016 Marsala et al.
9,494,033 B2 11/2016 Taherian et al.
9,557,434 B2 1/2017 Keller et al.
9,611,736 B2 4/2017 Marsala et al.
9,644,472 B2 5/2017 Fuhst et al.
9,651,700 B2 5/2017 Marsala et al.
9,689,253 B2 6/2017 Rivero
9,696,450 B2 7/2017 Marsala et al.
9,733,191 B2 8/2017 Bittar et al.
9,952,192 B2 4/2018 Donzier et al.
9,983,328 B2 5/2018 Marsala et al.
10,030,486 B1 7/2018 Keller
10,095,983 B1 10/2018 Venter et al.
10,125,546 B2 11/2018 Wu et al.
10,125,586 B2 11/2018 Balan et al.
10,132,952 B2 11/2018 Marsala et al.
10,145,975 B2 12/2018 Marsala et al.
10,156,654 B2 12/2018 Marsala et al.
10,254,430 B2 4/2019 Fang et al.
10,267,943 B2 4/2019 Marsala et al.
10,288,755 B2 5/2019 Cordery
10,294,771 B2 5/2019 Donzier et al.
10,570,716 B2 2/2020 Balan et al.
10,612,360 B2 4/2020 Al-Qasim et al.
10,677,034 B2 6/2020 Balan et al.
10,677,035 B2 6/2020 Balan et al.
10,808,529 B2 10/2020 Ow et al.
10,968,737 B2 4/2021 Marsala
2001/0017163 A1 8/2001 Penza
2004/0104052 A1* 6/2004 Livingstone ..... E21B 17/18 175/55
2004/0108110 A1 6/2004 Zupanick et al.
2004/0216872 A1* 11/2004 Foster ..... G01V 11/005 166/380
2004/0246141 A1 12/2004 Tubel et al.
2005/0034917 A1 2/2005 Mathiszik et al.
2005/0078555 A1 4/2005 Tang et al.
2005/0252286 A1 11/2005 Ibrahim et al.
2006/0044940 A1 3/2006 Hall et al.
2006/0104578 A1 5/2006 Herbst
2007/0256832 A1 11/2007 Hagiwara et al.
2008/0066960 A1 3/2008 Mathiszik
2008/0156534 A1* 7/2008 Clark ..... E21B 47/113 175/45
2008/0257546 A1 10/2008 Cresswell et al.
2008/0290874 A1 11/2008 Seleznev et al.
2009/0087911 A1 4/2009 Rogerio
2009/0164188 A1 6/2009 Habashy
2009/0288820 A1 11/2009 Barron et al.
2010/0109672 A1 5/2010 Rabinovich et al.
2010/0132448 A1 6/2010 Donadille et al.
2010/0198519 A1 8/2010 Wilt et al.
2010/0200248 A1 8/2010 Kriesels et al.
2010/0296100 A1 11/2010 Blacklaw
2011/0042083 A1 2/2011 Sierra et al.
2011/0088895 A1 4/2011 Pop et al.
2011/0309835 A1 12/2011 Barber et al.
2012/0016649 A1 1/2012 Thambynayagam et al.
2012/0024050 A1* 2/2012 Godager ..... E21B 47/10 73/152.05
2012/0062886 A1 3/2012 Piotti et al.
2012/0111561 A1 3/2012 Piotti et al.
2012/0178653 A1 7/2012 McClung, III
2012/0253680 A1 10/2012 Thompson
2012/0268135 A1 10/2012 Marsala et al.
2012/0325465 A1 12/2012 Hammer et al.
2013/0091941 A1 4/2013 Huh
2014/0041862 A1 2/2014 Ersoz
2014/0180592 A1 6/2014 Ravi
2014/0180658 A1 6/2014 Rossi
2014/0203810 A1 7/2014 Marsala et al.
2014/0203811 A1 7/2014 Marsala et al.
2014/0208843 A1 7/2014 Godfrey
2014/0238670 A1 8/2014 Pop et al.
2014/0239957 A1 8/2014 Zhang et al.
2014/0361777 A1 12/2014 Marsala et al.
2015/0061683 A1 3/2015 Marsala et al.
2015/0061684 A1 3/2015 Marsala et al.
2015/0132543 A1 5/2015 Nouzille et al.
2015/0204993 A1 7/2015 Leggett, III et al.
2015/0232748 A1 8/2015 Kanj et al.
2015/0370934 A1 12/2015 Pride et al.
2016/0041296 A1 2/2016 Ahmad et al.
2016/0061024 A1* 3/2016 Lubrecht ..... E21B 47/024 175/45
2016/0084067 A1* 3/2016 Harris ..... E21B 47/002 348/85
2016/0138390 A1 5/2016 Arntsen
2016/0259079 A1 9/2016 Wilson
2016/0282881 A1 9/2016 Filippov
2016/0291190 A1* 10/2016 Huang ..... E21B 49/003
2016/0291194 A1 10/2016 Marsala et al.
2017/0059668 A1 3/2017 Chang et al.
2017/0314385 A1 11/2017 Hori et al.
2017/0351000 A1 12/2017 Marsala et al.
2018/0010449 A1* 1/2018 Roberson ..... E21B 47/06
2018/0066515 A1 3/2018 Marsala et al.
2018/0128937 A1 5/2018 Donzier et al.
2018/0275306 A1 9/2018 Marsala et al.
2018/0298752 A1 10/2018 Balan et al.
2018/0320514 A1 11/2018 Felkl et al.
2018/0347349 A1 12/2018 Marsala

(56) References Cited

U.S. PATENT DOCUMENTS

| | | | |
|---|---|---|---|
| 2019/0003291 | A1 | 1/2019 | Balan et al. |
| 2019/0003292 | A1 | 1/2019 | Balan et al. |
| 2019/0011593 | A1 | 1/2019 | Marsala et al. |
| 2019/0100992 | A1* | 4/2019 | Glasgow, Jr. ..... E21B 47/01 |
| 2019/0107643 | A1 | 4/2019 | Golmohammadizangabad et al. |
| 2019/0112913 | A1* | 4/2019 | Song ..... E21B 41/00 |
| 2019/0169975 | A1 | 6/2019 | Al-Qasim et al. |
| 2019/0266501 | A1 | 8/2019 | Tavares |
| 2019/0293814 | A1 | 9/2019 | Horne |
| 2019/0339408 | A1 | 11/2019 | Davies |
| 2019/0368336 | A1 | 12/2019 | Hammond et al. |
| 2019/0391034 | A1 | 12/2019 | Al Jabri |
| 2020/0030777 | A1 | 1/2020 | Al-Jabri et al. |
| 2020/0031738 | A1 | 1/2020 | Al-Jabri et al. |
| 2020/0032148 | A1 | 1/2020 | Al-Jabri et al. |
| 2020/0034711 | A1 | 1/2020 | Misra et al. |
| 2020/0116019 | A1 | 4/2020 | Ow et al. |
| 2020/0208513 | A1 | 7/2020 | Al-Qasim et al. |
| 2020/0408089 | A1 | 12/2020 | Ow et al. |

FOREIGN PATENT DOCUMENTS

| | | |
|---|---|---|
| EP | 1803001 | 2/2012 |
| EP | 2966257 | 1/2016 |
| GB | 2489714 | 10/2012 |
| GB | 2563739 | 12/2018 |
| WO | WO 2005119303 | 12/2005 |
| WO | WO 2006059057 | 6/2006 |
| WO | WO 2010135584 | 11/2010 |
| WO | WO 2011129828 | 10/2011 |
| WO | WO 2012115717 | 8/2012 |
| WO | WO 2014051789 | 4/2014 |
| WO | WO 2014058425 | 4/2014 |
| WO | WO 2014060562 | 4/2014 |
| WO | WO 2014144917 | 9/2014 |
| WO | WO 2014207075 | 12/2014 |
| WO | WO 2015016932 | 2/2015 |
| WO | WO 2015027084 | 2/2015 |
| WO | WO 2015167935 | 11/2015 |
| WO | WO 2015187142 | 12/2015 |
| WO | WO 2015192226 | 12/2015 |
| WO | WO 2016200374 | 12/2016 |
| WO | WO 2018085504 | 5/2018 |
| WO | WO 2018234431 | 12/2018 |

OTHER PUBLICATIONS aflglobal.com' [online], "MiniBend Fiber Optic Component for Downhole Double-Ended Systems and Optical Connectivity," available on or before Jun. 8, 2012, retrieved on Jun. 12, 2018, retrieved from URL: <https://www.aflglobal.com/productlist/Product-Lines/Fiber-Optic-Cable/MiniBend_for_Downhole_Double-Ended_Systems_Optic/doc/MiniBend.aspx>, 1 page.

Ali et al., "Constraining Interwell Water Flood Imaging with Geology and Petrophysics: An Example from the Middle East," SPE 120558, Society of Petroleum Engineers (SPE), presented at the 2009 SPE Middle East Oil & Gas Show and Conference, Bahrain, Mar. 15-18, 2009, 11 pages.

Alkhatib et al., "Robust Quantification of Uncertainty in Heterogeneity for Chemical EOR Processes: Applying the Multi-Level Monte Carlo Method," SPE-172635-MS, Society of Petroleum Engineers (SPE), presented at the SPE Middle East Oil & Gas Show and Conference, Bahrain, Mar. 8-11, 2015, 13 pages.

Allard et al., "Core-shell type dually fluorescent polymer nanoparticles for ratiometric pH-sensing," J. Polym. Sci., Part A: Polym. Chem., 2008, 46(18):6206-6213, 8 pages.

Alsaif et al., "Petrophysical Joint Inversion for Reservoir Saturation Mapping: A Case Study," SPE-188143-MS, Society of Petroleum Engineers (SPE), presented at the SPE Kingdom of Saudi Arabia Annual Technical Symposium and Exhibition held in Dammam, Saudi Arabia, Apr. 24-27, 2017, 7 pages.

Al-Shehri et al., "Illuminating the Reservoir: Magnetic NanoMappers," SPE 164461, Society of Petroleum Engineers (SPE), presented at the SPE Middle East Oil and Gas Show and Exhibition on Mar. 10-13, 2013, 10 pages.

Bakulin et al., "Smart DAS upholes for near surface model building and deep imaging with vertical arrays," International Conference on Engineering Geophysics, Oct. 2017, 5 pages.

Behnke et al., "Encapsulation of Hydrophobic Dyes in Polystyrene Micro- and Nanoparticles via Swelling Procedures," J. Fluoresc., 2011, 21(3):937-944, 8 pages.

Bennetzen et al., "Novel Applications of Nanoparticles for Future Enhanced Oil Recovery", IPTC-17857-MS, presented at the International Petroleum Technology Conference (IPTC), Dec. 10-12, 2014, 14 pages.

Brie et al., "Shear Sonic Interpretation in Gas-Bearing Sands," SPE 30595, Society of Petroleum Engineers (SPE), presented at the SPE Annual Technical Conference and Exhibition, Oct. 22-25, 1995, 10 pages.

Burtman et al., "Experimental Study of Induced Polarization Effect in Unconventional Reservoir Rocks," Geomaterials 04:04, Jan. 1, 2014, 13 pages.

Carey et al., "Analysis of water hammer signatures for fracture diagnostics," SPE-174866-MS, Society of Petroleum Engineers (SPE), presented at the SPE Annual Technical Conference and Exhibition, Jan. 2015, 26 pages.

Chaki et al., "Well Tops Guided Prediction of Reservoir Properties using Modular Neural Network Concept: A Case Study from Western Onshore, India," Indian Institute of Technology, 24 pages.

Cheng et al., "Comparison of Q-estimation methods: an update," Q-estimation, CREWES Research Report, 25, 2013, 38 pages.

Cheng et al., "Estimation of Q: a comparison of different computational methods," Integration geoConvention 2013, Geoscience Engineering Partnership, 4 pages.

Davydycheva et al., "Electrical-Prospecting Method for Hydrocarbon Search Using the Induced-Polarization Effect," Geophysics, Society of Exploration Geophysicists, 71:4, Jul. 1, 2006, 11 pages.

Deschamps et al., "Drilling to the Extreme: the Micro-Coring Bit Concept," IADC/SPE 115187, International Association of Drilling Contractors (IADC), Society of Petroleum Engineers (SPE), presented at the IADC/SPE Asia Pacific Drilling Technology Conference and Exhibition, Aug. 25-27, 2008, 12 pages.

Desmette et al., "Drilling Hard and Abrasive Rock Efficiently, or Generating Quality Cuttings? You No. Longer Have to Choose . . . ," SPE 116554, Society of Petroleum Engineers (SPE), 2008 SPE Annual Technical Conference and Exhibition, Sep. 21-24, 2008, 19 pages.

Dunham et al., "Hydraulic fracture conductivity inferred from tube wave reflections," In SEG Technical Program Expanded Abstracts 2017, 947-952, Society of Exploration Geophysicists, 6 pages.

Georgi, et al., "Advances in Cuttings Collection and Analysis," SPWLA 34th Annual Logging Symposium, Jun. 13-16, 1993, 20 pages.

Giles, "Multilevel Monte Carlo path simulation," Operations Research, 56:3 (607-617), May-Jun. 2008.

gpxsurveys.com.au' [online], "Ground Geophysics Induced Polarisation", available on or before Mar. 10, 2015, [retrieved Mar. 10, 2015], retrieved from URL: <http://www.gpxsurveys.com.au/Ground-Geophysics/Induced-Polarisation>, 2 pages.

Kumar et al., "Petrophysical evaluation of well log data and rock physics modeling for characterization of Eocene reservoir in Chandmari oil field of Assam-Arakan basin, India," J Petrol Explor Prod Technol, 2018, 8: 323-340, 18 pages.

Li et al., "A Comparative Study of the Probabilistic-Collocation and Experimental-Design Methods for Petroleum-Reservoir Uncertainty Quantification," SPE Journal, 16:2 (429-439), Jun. 2011.

Liang et al., "Crosswell Electromagnetic Inversion Constrained by the Fluid-Flow Simulator," Paper presented at the SPE Annual Technical Conference and Exhibition, Florence, Italy, Sep. 19-22, 2010; 11 pages.

Liang et al., "Hydraulic fracture diagnostics from Krauklis-wave resonance and tube-wave reflections," Geophysics, 82(3): D171-D186, May-Jun. 2017, 16 pages.

(56) References Cited

OTHER PUBLICATIONS

Marsala et al., "3D inversion practice for crosswell electromagnetic surveys in horizontal wells in Saudi Arabia," 85th Annual International Meeting, SEG, 2015; 4 pages.
Marsala et al., "Crosswell electromagnetic induction between two widely spaced horizontal wells: Coiled-tubing conveyed data collection and 3D inversion from a carbonate reservoir in Saudi Arabia," 85th Annual International Meeting, SEG, 2015; 4 pages.
Marsala et al., "Crosswell Electromagnetic Tomography: from Resistivity Mapping to Interwall Fluid Distribution", IPTC 12229-PP, presented at the International Petroleum Technology Conference (IPTC) on Dec. 3-5, 2008, 6 pages.
Marsala et al., "First Borehole to Surface Electromagnetic Survey in KSA: reservoir mapping & monitoring at a new scale", Spe 146348-PP, Society of Petroleum Engineers (SPE), presented at the SPE Annual Technical Conference and Exhibition, Oct. 30-Nov. 2, 2011, 10 pages.
Marsala et al., "Fluid Distribution Inter-Well Mapping in Multiple Reservoirs by Innovative Borehole to Surface Electromagnetic: Survey Design and Field Acquisition," IPTC-17045, presented at the International Petroleum Technology Conference (IPTC), Beijing, China, Mar. 26-28, 2013; 4 pages.
Mohaghegh et al., "A Methodological Approach for Reservoir Heterogeneity Characterization Using Artificial Neural Networks," SPE 28394, Society of Petroleum Engineers (SPE), presented at the SPE Annual Technical Conference & Exhibition held in New Orleans, LA, U.S.A., Sep. 25-28, 1994; Society of Petroleum Engineers, 1994, 5 pages.
Munn et al., "Novel cable coupling technique for improved shallow distributed acoustic sensor VSPs," Journal of Applied Geophysics 138, Mar. 2017, 8 pages.
Musyanovych et al., "Preparation of Biodegradable Polymer Nanoparticles by Miniemulsion Technique and Their Cell Interactions," Macromolecular Bioscience, Feb. 2008, 8(2): 127-139, 13 pages.
openfield-technology.com [online], retrieved from URL <https://www.openfield-technology.com/>, 8 pages.
Poitzsch et al., "Nanoparticle Tags for Improved Depth Correlation," IPTC-19785, International Petroleum Technology Conference (IPTC), IPTC Conference 2020, 2 pages (abstract only).
Rafik et al., "Prediction of permeability and porosity from well log data using the nonparametric regression with multivariate analysis and neural network, Hassi R'Mel Field, Algeria," Egyptian Journal of Petroleum, 2017, 26: 763-778, 16 pages.
Rahmani et al., "Characterizing Reservoir Heterogeneities Using Magnetic Nanoparticles", SPE-173195-MS, Society of Petroleum Engineers (SPE), presented at the SPE Reservoir Simulation Symposium on Feb. 23-26, 2015, 29 pages.
Reisch et al., "Fluorescent Polymer Nanoparticles Based on Dyes: Seeking Brighter Tools for Bioimaging," Small, Apr. 2016, 12(15):1968-1992, 48 pages.
Rovetta et al., "Petrophysical Inversion of Resistivity Logging Data," SPE-184030-MS, Society of Petroleum Engineers (SPE), presented at the SPE Middle East Oil and Gas Show and Conference, Manama, Bahrain, Mar. 6-9, 2017, 13 pages.
Salehi et al., "Estimation of the non-records logs from existing logs using artificial neural networks," Egyptian Journal of Petroleum, 2017, 26: 957-968, 12 pages.
Santarelli et al., "Formation Evaluation From Logging on Cuttings," SPE Reservoir Evaluation and Engineering, presented at the 1996 SPE Permian Basin Oil and Gas Recovery Conference, Mar. 27-29, 1996, 7 pages.
Tang and Cheng, "A dynamic model for fluid flow in open borehole fractures," Journal of Geophysical Research: Solid Earth, 94: 7567-7576, Jun. 10, 1989, 10 pages.
Tatang et al., "An efficient method for parametric uncertainty analysis of numerical geophysical models," Journal of Geophysical Research, 102:D18 (925-21, 932), Sep. 27, 1997; pp. 21.
Tonn, "The determination of the seismic quality factor Q from VSP data: a comparison of different computational methods," Geophysical Prospecting, 39, 1991, 27 pages.
U.S. Appl. No. 62/513,822, Bakulin et al., Detecting Sub-Terranean Structures, filed Jun. 1, 2017, 52 pages.
Vandamme et al., "How the Invasion Zone Can Contribute to the Estimation of Petrophysical Properties from Log Inversion at Well Scale?" SPWLA 58th Annual Logging Symposium, SPWLA-2017-JJJ, Jun. 17-21, 2017, 16 pages.
Verma et al., "Porosity and Permeability Estimation using Neural Network Approach from Well Log Data," GeoConvention 2012: Vision, 2012, 6 pages.
Vollrath et al., "Fluorescence imaging of cancer tissue based on metal-free polymeric nanoparticles—a review," J. Mater. Chem. B, Mar. 2013, 1(15):1994-2007, 15 pages.
Wilt et al., "Monitoring a Water Flood of Moderate Saturation Changes with Crosswell Electromagnetics (Em): A Case Study from Dom Joao Brazil," Paper presented at the SEG Las Vegas 2012 Annual Meeting, 2012; 4 pages.
Zhang et al., "Petrophysical Inversion of Resistivity Logging Data," SPE-63285-MS, Society of Petroleum Engineers (SPE), presented at the 2000 SPE Annual Technical Conference and Exhibition, Dallas, Texas, Oct. 1-4, 2000, 8 pages.
Zhdanov et al., "Carbonate Reservoir Rocks Show Induced Polarization Effects, Based on Generalized Effective Medium Theory", 75th EAGE Conference & Exhibition, Jun. 2013, 5 pages.

* cited by examiner

INSTRUMENTED MANDREL FOR COILED TUBING DRILLING

CROSS-REFERENCE TO RELATED APPLICATION(S)

This application is a U.S. National Phase Application under 35 U.S.C. § 371 and claims the benefit of priority to International Application Serial No. PCT/IB2020/000528, filed May 26, 2020, the contents of which are hereby incorporated by reference.

BACKGROUND

The production of crude oil and other hydrocarbons starts with the drilling of a wellbore into a hydrocarbon reservoir. In many cases, the hydrocarbon reservoir is a narrow layer of material in the subterranean environment, making efficient targeting of the wellbore important for productivity. Accordingly, directional drilling is often used to direct a drill bit to form a wellbore in the reservoir layer.

Drilling may be performed by a rotating drill string, which uses the rotation of the drill string to power a bit to cut through subterranean layers. Changing the orientation of the bit for directional drilling may be performed using a mud motor, for example, by stopping the rotation of the drill string, and activating the mud motor to power the drill bit while the drill string is slid forward down the well, while a bent section of the bottom hole assembly orients the drill string in a new direction. Any number of other techniques have been developed to perform directional drilling.

More recent developments have been in the use of coiled tubing drilling for directional drilling. Directional drilling using coiled tubing may be performed by a mud motor used with hydraulic actuators to change the direction of the bit.

Controlling the direction of the drill string in directional drilling, termed geosteering herein, may be done using any number of techniques. In early techniques, drilling was halted and downhole instrumentation, coupled to the surface by a wireline, was lowered into the wellbore. The wireline instrumentation was used to collect information on the inclination of the end of the wellbore and a magnetic azimuth of the end of the wellbore. This information was used in concert with the depth of the end of the wellbore, for example, measured by the length of the wireline or drill string, to determine the location of the end of the wellbore at a point in time, termed a survey. Collection of a number of surveys was needed to determine the changes needed in drilling operations for geosteering a wellbore to a reservoir layer.

Developments have continued on wireline instrumentation for logging. For example, U.S. Pat. No. 8,726,983 describes a method and apparatus for performing wireline logging operations in an underbalanced well. Well logging equipment is installed while holding the underbalanced open hole at its optimal pressure. The locking string is conveyed on a drill string to total depth and logging, while removing the logging string. However, this reference does not discuss logging while drilling.

SUMMARY

An embodiment described herein provides a system for measuring parameters while drilling a wellbore using a coiled tubing drilling apparatus. The system includes an instrumented mandrel including a notch in an outer surface of the instrumented mandrel, and an indentation at each end of the notch. A sensor package in the system includes a sensor, a tubular assembly, and a mounting bracket at each end of the tubular assembly. The sensor package is sized to fit in the notch, with each of the mounting brackets fitting in one of the indentations at each end of the knot, and wherein the sensor package is substantially flush with the instrumented mandrel.

Another embodiment described herein provides a method for assembling a bottom hole assembly for coiled tubing drilling that includes an instrumented mandrel. The method includes selecting a configuration for the bottom hole assembly, selecting a sensor, assembling a sensor package, and mounting the sensor package on the instrumented mandrel. The bottom hole assembly for the coiled tubing drilling is assembled and mounted on a coiled tubing apparatus.

Another embodiment described herein provides a method for geosteering a wellbore using an instrumented mandrel in a bottom hole assembly on a coiled tubing drilling apparatus. The method includes measuring a response from a sensor disposed in a sensor package on the instrumented mandrel in the bottom hole assembly, determining a parameter from the response, and logging the parameter. Adjustments to geosteering vectors for the bottom hole assembly are determined based on the parameter.

DETAILED DESCRIPTION

Figure 1:
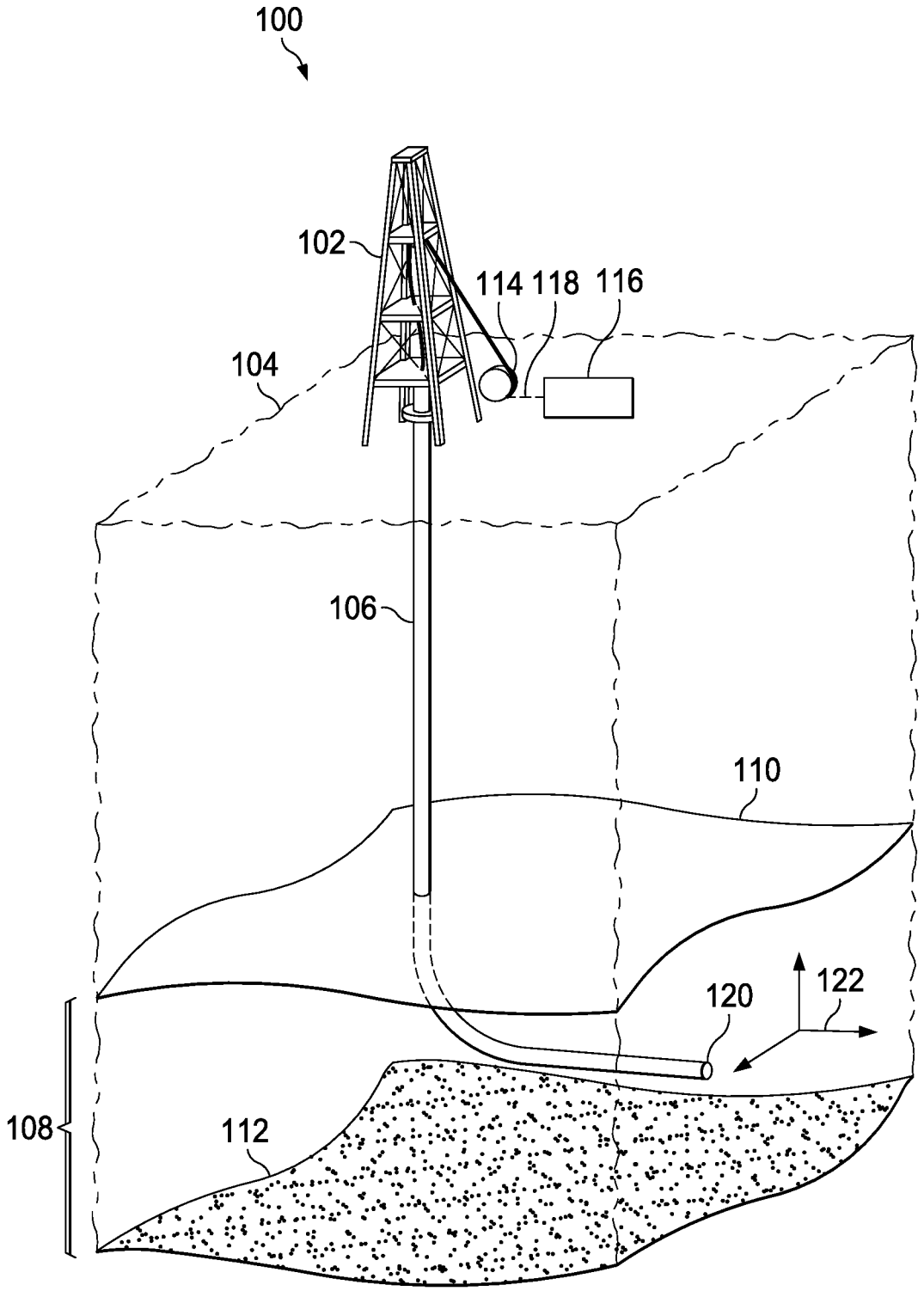
FIG. 1 is a schematic drawing of a method for geosteering a well during directional drilling using instrumented mandrels.

Production Logging (PLT) is one of the key technologies to measure fluid properties in the oil industry. If this is done while drilling, termed logging while drilling (LWD) herein, the measured data can be used to support drilling operations. The data collected in the LWD may be retrieved from the well by pulling the coiled tubing from the well and downloading data from memory chips that have stored the data. In other examples the data may be sent to the surface through pulse telemetry, wireline connections, or other techniques. This is termed measurement while drilling (MWD) herein. Generally, LWD is used to describe both concepts herein.

The data may be used to geosteer the wells, e.g., direct the drilling trajectory using hydrocarbon production information. This may allow the well to be targeted inside the most prolific reservoir layers. In some applications, the log data from the LWD may be used to change the trajectory of the wells once it is analyzed. In other applications, the data collected in real time from the MWD may be used to either automate the trajectory control, or to provide information to an operator to change the trajectory if needed.

Coiled tubing may be used to drill wellbores in an underbalanced condition, in which the pressure in the formation is lower than the pressure in the wellbore. This may be performed by using a sealed surface system that allows the coiled tubing to pass through while sealing around it, and diverting fluids flowing into the wellbore. Drilling in an underbalanced condition protects the reservoir from damage due to drilling fluids, leak off, and other conditions, as fluids, including gas flowing into the wellbore during the drilling process. In drilling of gas wells in underbalanced conditions, gas from the formation is flowing in the annulus, i.e., the region in the wellbore between the logging tool and the rock formation. This allows the use of the LWD/MWD techniques described herein.

Provided herein are LWD/MWD techniques that allow the measurement and evaluation of the gas produced inside the borehole, thanks to a tool assembly that includes different sensors. The data collected supports geosteering in more productive gas or oil layers of a reservoir. The techniques also relate to measurements of multi-phasic flows in oil and gas wells at downhole conditions, such as oil-based muds, water-based fluids, or pressurized gas drilling fluids, among others. Production Logging (PL), including LWD and MWD of oil and gas wells has numerous challenges related to the complexity of multiphasic flow conditions and severity of downhole environment.

In particular, gas, oil, water, mixtures flowing in wells, will present bubbles, droplets, mist, segregated wavy, slugs, and other structures depending on relative proportions of phases, their velocities, densities, viscosities, as well as pipe dimensions and well deviations. Accordingly, in order to achieve good understanding of individual phases a number of parameters must be measured, including, for example, flowrates, bubble contents, water content, and the like.

The wellbores provide an aggressive environment that may include including high pressures, for example, up to 2000 bars, high temperature, for example, up to 200° C., corrosivity from $H_2S$ and $CO_2$, and high impacts. These environmental conditions place constraints on sensors and tool mechanics. Further, solids present in flowing streams, such as cuttings and produced sand, can damage equipment. In particular, sand entrained from reservoir rocks will erode parts facing flow. Solids precipitated from produced fluids due to pressure and temperature changes, such as asphalthenes, paraffins or scales, create deposits that can contaminate sensors and or blocking moving parts, such as spinners. Cost is also an important parameter in order to provide an economically viable solution to well construction optimization.

FIG. 1 is a schematic drawing of a method 100 for geosteering a well during directional drilling using instrumented mandrels. In the method 100, a drilling rig 102 at the surface 104 is used to drill a wellbore 106 to a reservoir layer 108. In this illustration, the reservoir layer 108 is bounded by an upper layer 110, such as a layer of cap rock, and a lower layer 112, such as a layer containing water.

The drilling rig 102 is coupled to a roll of coiled tubing 114, which is used for the drilling. A control shack 116 may be coupled to the roll of coiled tubing 114 by a cable 118 that includes transducer power lines and other control lines. The cable 118 may pass through the coiled tubing 114, or alongside the coiled tubing 114, to the end 120 of the wellbore 106, where it couples to the BHA used for drilling the wellbore 106.

In some embodiments described herein, a cable is not used as the sensor packages are powered by batteries. In some of these embodiments, the BHA communicates with the surface through other techniques, such as mud pulse telemetry (MPT). In other embodiments, the BHA logs measurements, which can be collected when the coiled tubing 114 is pulled from the wellbore 106. For example, when pressurized gas is used as the drilling fluid, MPT is ineffective as the compressibility of the gas damps the signals, preventing communications.

In embodiments described herein, the sensors measure the components and velocity of materials passing through the outer annulus of the wellbore 106, for example, measuring velocity, phases, and the like. Further, radio communications using EM signals between downhole units may be used to sense proximity and distance to water, such as in the lower layer 112. The trend of these measurements may be used to determine whether the BHA is within a producing zone of the reservoir layer 108, has left the producing zone, or is approaching the lower layer 112. This information, along with the information on the structure of the layers 110 and 112, is used to adjust the vectors 122 to steer the wellbore 106 in the reservoir layer 108 back towards a product zone. For example, if the material flowing into the wellbore in the unbalanced drilling is increasing in water or fluids, the BHA may be approaching the lower layer 112. Other sensors, such as EM sensors, may be used to confirm the presence of the water layer. Accordingly, the vectors 122 may be adjusted to direct the BHA back towards a gas zone in the reservoir layer 108.

Figure 2:
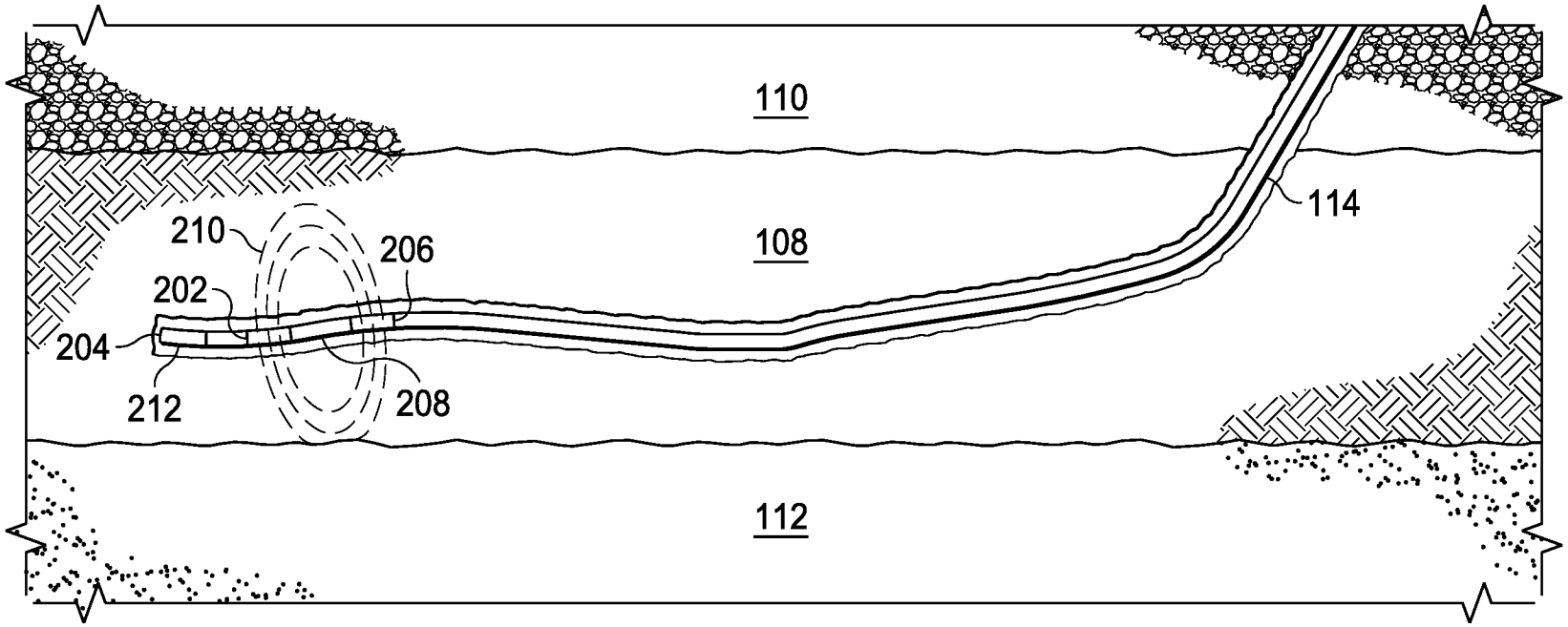
FIG. 2 is a schematic drawing of geosteering a wellbore.

FIG. 2 is a schematic drawing of geosteering a wellbore. Like numbered items are as described with respect to FIG. 1. In this embodiment, the BHA 200 has two instrumented mandrels. A first mandrel 202 is located nearer a drillbit 204 and a second mandrel 206 is located further away from the drillbit 204, separated from the first mandrel 202 by a spacer pipe 208.

The two mandrels 202 and 206 may communicate with each other, for example, through electromagnetic signals 210 linking radiofrequency antennae on each of the mandrels 202 and 206. This enables the communication system with the surface to be installed in only one of the mandrels. For example, the second mandrel 206 may be located farther from the drillbit 204, and may handle communications with the surface, using a mud pulse telemetry (MPT) system. The first mandrel 202 may be located closer to the drill bit 204, and send data to the second mandrel 206 to be sent to the surface.

In addition to measurement trends, e.g., in time, the separations of the sensors between the first mandrel 202 and the second mandrel 206 provide a separation of measurements in space, allowing targeting to be performed based on the differences in the measurements between each mandrel 202 and 206. For example, if a higher water content is measured at the first mandrel 202 then at the second mandrel 206, it may indicate that the drillbit 204 is approaching the lower layer 112. Accordingly, the trajectory of the wellbore 106 may be adjusted to bring the drillbit 204 back into the reservoir layer 108.

Trends over time of sensor readings at the mandrels 202 and 206 may also be used for geosteering. For example, if the water measured at the first mandrel 202 increases, this may indicate that the drillbit 204 is nearing the lower layer 112 and may be leaving the reservoir layer 108. A telemetry package 212 may also be located directly behind the drillbit 204 to provide further information about the location of the drillbit 204. This may include seismic detectors and transducers that can locate the drillbit 204 in three-dimensional space.

Figure 3:
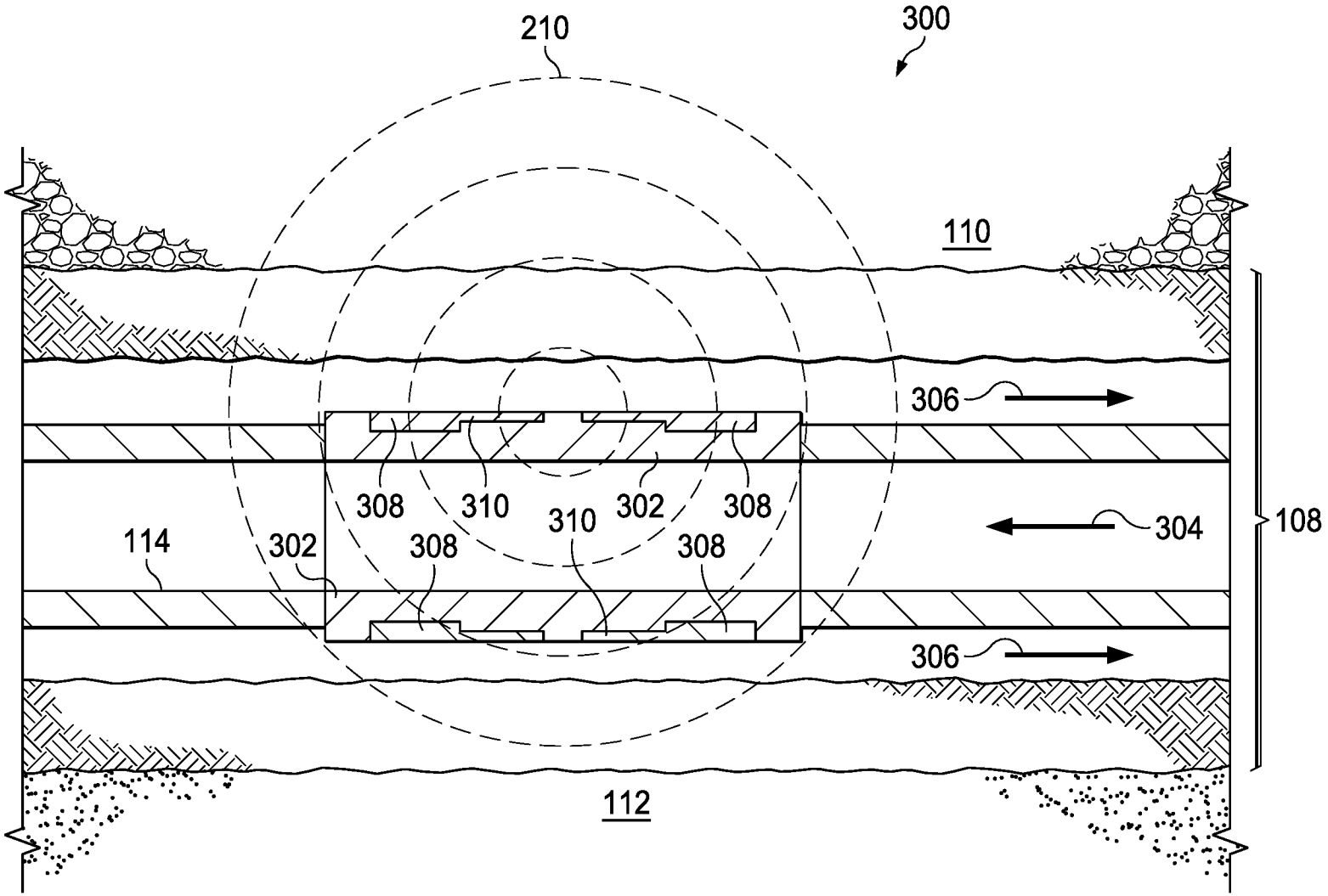
FIG. 3 is a schematic drawing of fluid flow through an instrumented mandrel.

FIG. 3 is a schematic drawing 300 of fluid flow through an instrumented mandrel 302. Like numbered items are as described with respect to FIGS. 1 and 2. In this schematic drawing 300, drilling fluid 304 from the surface flows through the coil tubing 114 in the direction of the drill bit. A mixture 306 of drilling fluid 304 and produced fluids is returned to the surface through the annulus. In addition to the drilling fluid 304, the mixture 306 may include gas, oil, and reservoir water.

The mandrel 302 is equipped with sensor packages 308 to measure parameters of the mixture 306. The sensor packages 308 may include an ultrasonic Doppler system to measure the velocity of the mixture 306. For example, an ultrasonic transducer is oriented to emit an ultrasonic wave into the mixture 306, which is reflected off bubbles or particles in the mixture 306. An ultrasonic detector picks up the reflected sound and can be used to calculate the velocity from the frequency shift as particles or bubbles approach the detector. The ultrasonic Doppler system can also provide the information to determine the gas content of the two-phase stream in the annulus of the wellbore, for example, by quantitating the bubbles of an internal phase and determining their size. In some embodiments, a micro spinner is included to measure the flow velocity instead of, or in addition to, the Doppler measurement. The micro spinner may use an electrical coil or a magnet to detect spinning rate, which is proportional to the flow rate of the mixture 306.

The sensor packages 308 may include a MEMS pressure transducer to measure pressure outside of the mandrel 302. A conductivity probe may be included to measure fluid conductivity at a high frequency, allowing a determination of hydrocarbon to water phase. In some embodiments, an optical probe may be used instead of the conductivity probe to determine the composition of the mixture 306.

The information from the sensor packages 308 is combined with information from other geophysical measurements to assist in geosteering. For example, seismic measurements may be used to determine probable locations of boundary layers 110 and 112. As described herein, geophysical models may be generated and used with the data from the sensors, such as gyroscopes, inclinometers, and the like.

The mandrel 302 may also include radiofrequency (RF) antennae 310 to communicate with other mandrels, or with the telemetry package 212 (FIG. 2), using radiofrequency communications, i.e., electromagnetic (EM) signals 210. In addition to providing communications, the EM signals 210 may be used to determine the proximity of the mandrel 302 to water, for example, in the lower layer 112. This may be performed, for example, by measuring a loss in the signal-to-noise ratio in the EM signals 210 between the mandrel 302 and other mandrels in the bottom hole assembly.

Figure 4:
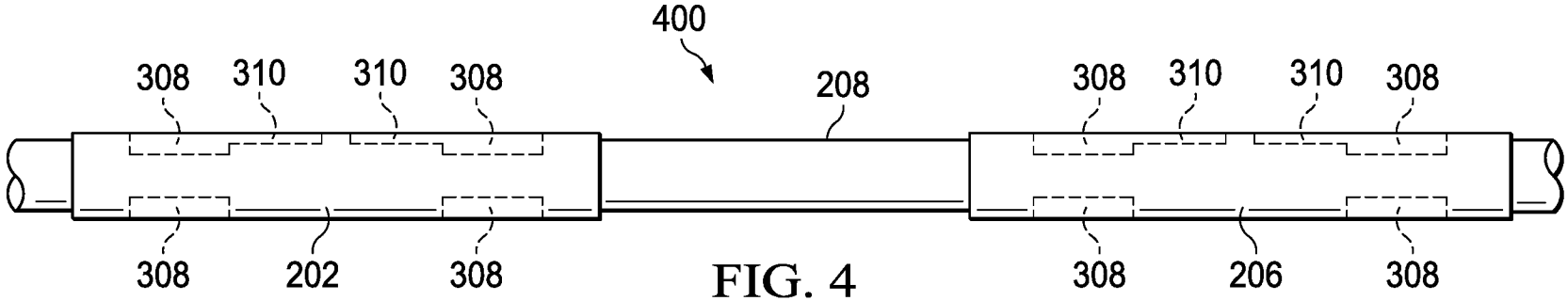
FIG. 4 is a drawing of an instrumented bottom hole assembly (BHA) that may be used for geo-steering in directional drilling in coiled tubing drilling (CTD) using measurements from exterior sensors mounted on an instrumented mandrel.

FIG. 4 is a drawing of an instrumented bottom hole assembly (BHA) 400 that may be used for geo-steering in directional drilling in coiled tubing drilling (CTD) using measurements from exterior sensors mounted on an instrumented mandrel. Like numbered items are as described with respect to FIGS. 2 and 3. In this embodiment, the instrumented BHA 400 includes two instrumented mandrels 202 and 206. The instrumented BHA 400 is sized to fit at the end of a coiled tubing string, as described herein. Accordingly, in various embodiments, the diameter of the instrumented mandrels 202 and 206 is between about 10 centimeters (cm) and 15 cm, or about 8.3 cm. Generally, the size of the instrumented mandrels 202 and 206 is selected based, at least in part, on the size of the drillbit and mud motor.

The exterior sensors are included in sensor packages 308 which are assembled before mounting. The sensor packages 308 are mounted along each of the mandrels 202 and 206, for example, in embedded slots formed in the outer surface of the mandrels 202 and 206, as described with respect to FIGS. 5 and 6. The sensor packages 308 may include multiple sensors assembled into a single package of sensors, as described with respect to FIGS. 7 and 8. The sensors may include micro electro mechanical systems (MEMS) pressure sensors, temperature sensors, optical sensors, ultrasonic sensors, conductivity sensors, and the like, as described with respect to FIGS. 9 to 11. The sensors are available from OpenField Technologies of Paris, France (https://www.openfield-technology.com/).

The sensor packages 308 may include communications devices, such as mud pulse telemetry devices used to communicate with the surface and EM communication devices used to communicate between the mandrels 202 and 206, and other downhole systems, such as the telemetry package. The EM communication devices may be linked to separate RF antennae 310, mounted along the mandrel, or may be linked to antennae mounted inside the sensor packages 308.

Figure 5:
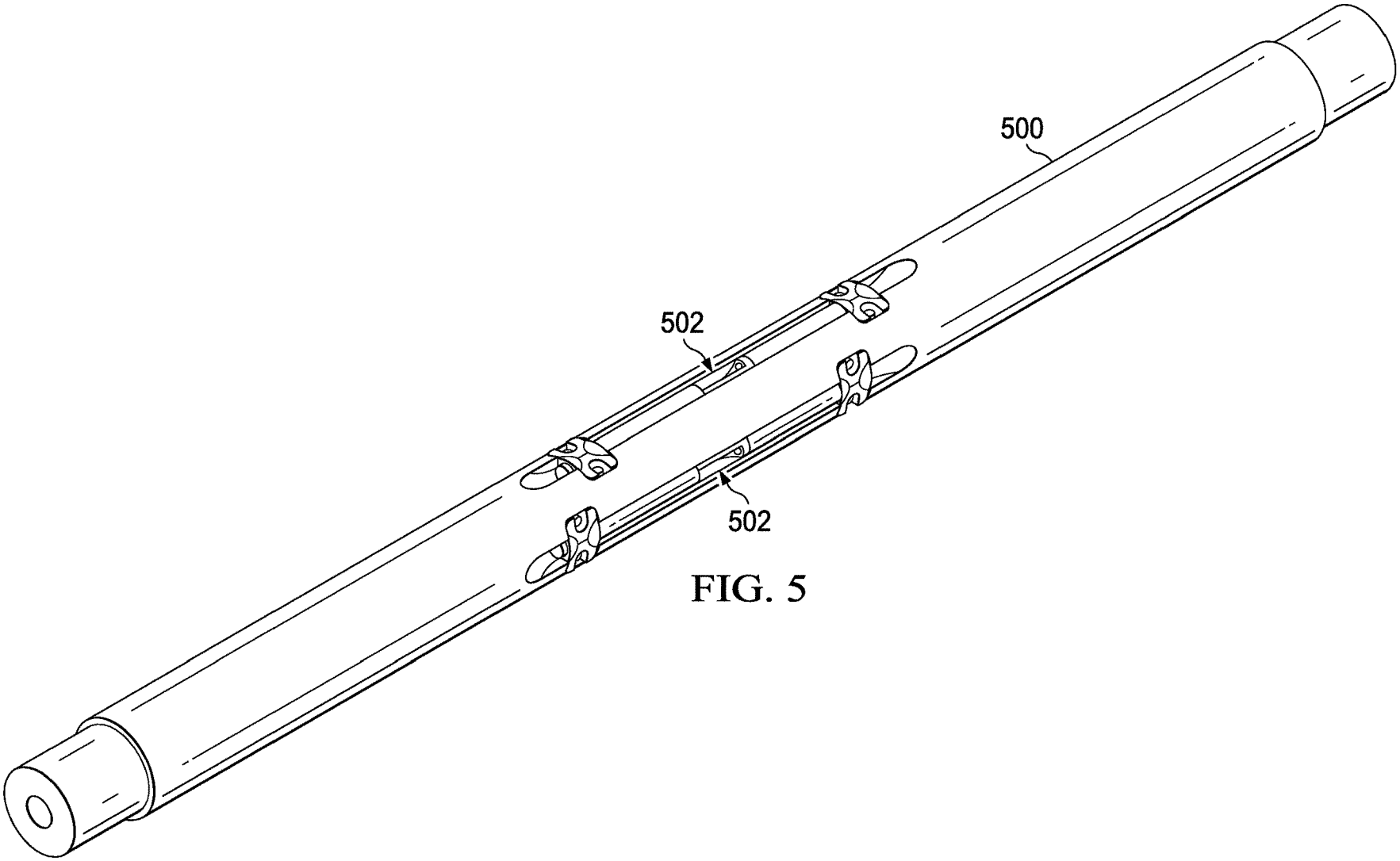
FIG. 5 is a perspective view of an instrumented mandrel, showing the sensor packages installed in notches in the outer surface of the mandrel.

FIG. 5 is a perspective view of an instrumented mandrel 500, showing the sensor packages 502 installed in notches in the outer surface of the mandrel. Once installed, the sensor packages 502 fit substantially flush to the mandrel 500, protecting the sensors in the sensor packages 502 from damage from the wellbore. The installation of the sensors on the exterior side of the mandrel 500 allows the sensors to monitor the composition and parameters of the mixture of drilling fluid and wellbore fluids that is flowing around the mandrel 500 it the annulus of the wellbore. The mandrel 500 may have multiple sensor packages 502 mounted along the instrumented mandrel 500, such as two sensor packages, four sensor packages, or more depending on the application. This allows for the standardization of the instrumented mandrels 500. However, the sensor packages 502 attached to the instrumented mandrels 500 may be customized with respect to the sensors selected, allowing mapping of the measured parameters across the cross-section of the well.

Figure 6:
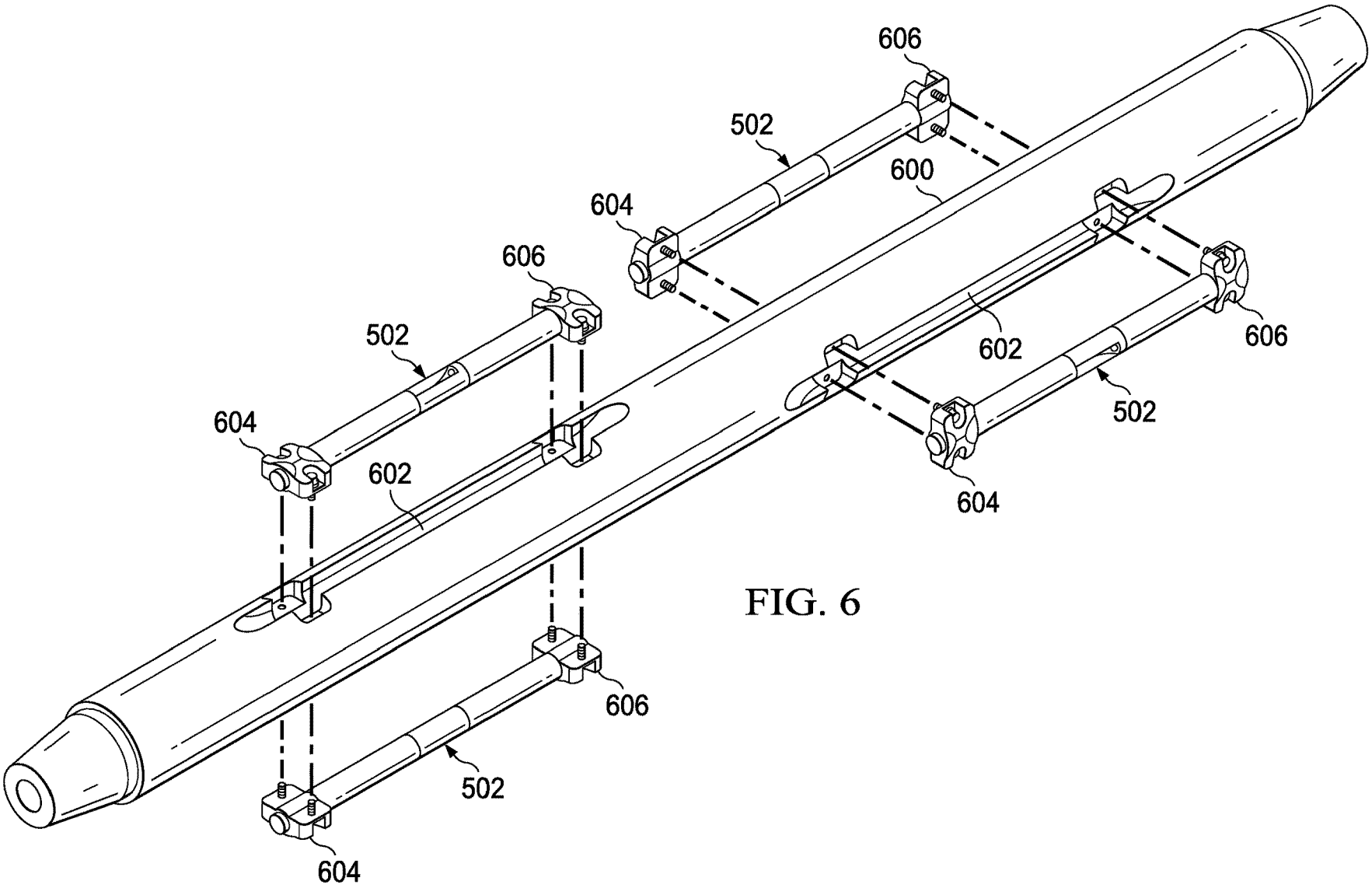
FIG. 6 is a perspective view of another design of an instrumented mandrel, showing the sensor packages removed from the notches in the outer surface of the instrumented mandrel.

FIG. 6 is a perspective view of another design of an instrumented mandrel 600, showing the sensor packages 502 removed from the notches 602 in the outer surface of the instrumented mandrel 600. Like numbered items are as described with respect to FIG. 5. The sensor packages 502 are mounted to the instrumented mandrel 600 through mounting blocks 604 and 606 at each end of the sensor packages 502. The mounting blocks 604 and 606 are placed in matching indentations at each end of the notches 602, and are then held in place by recessed screws, holding the sensor packages 502 in the notches 602 along the instrumented mandrel 600.

Figure 7:
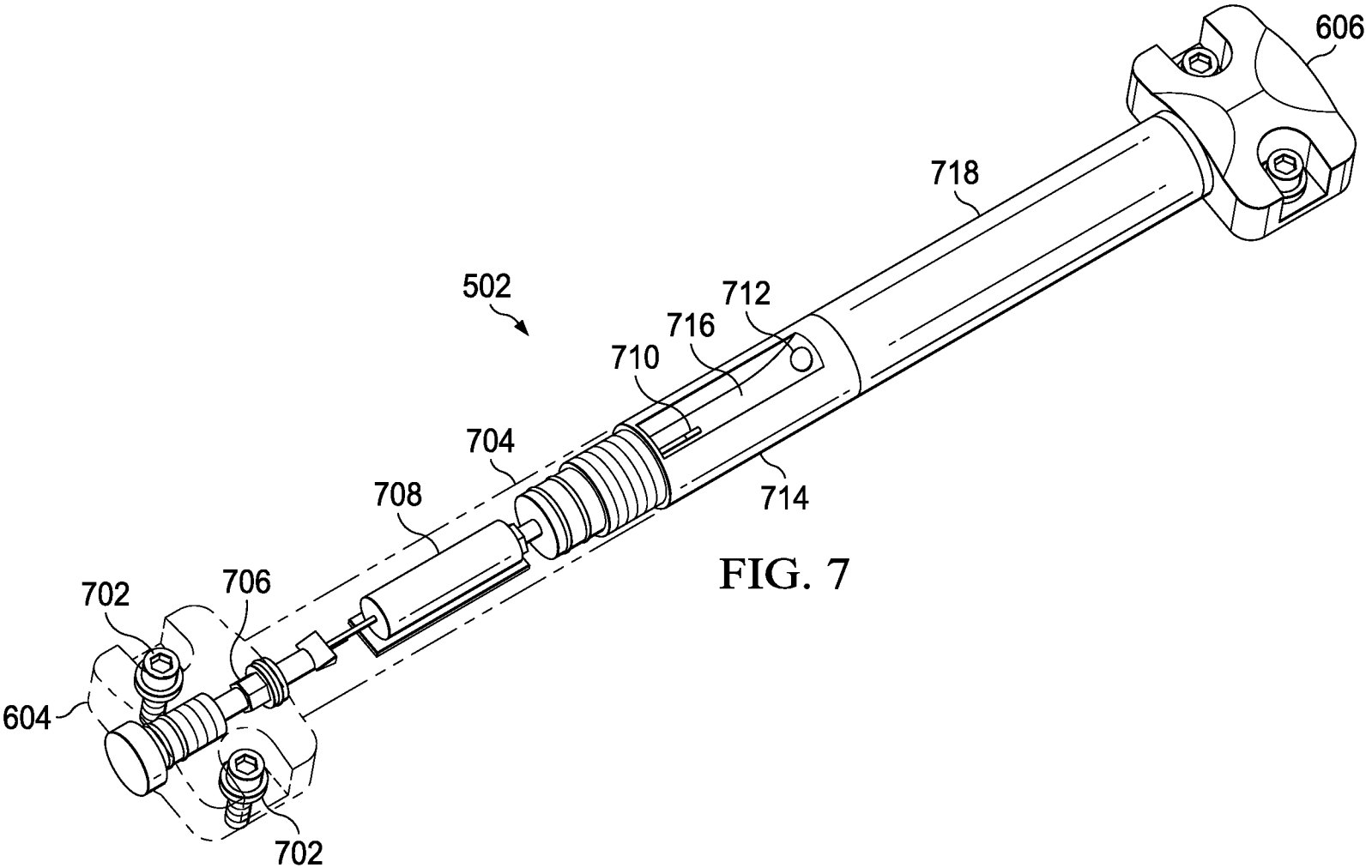
FIG. 7 is a drawing of a sensor package that includes an ultrasonic Doppler sensor and a fluid identification probe. Like numbered items are as described with respect to FIGS. 5 and 6.

FIG. 7 is a drawing of a sensor package 502 that includes an ultrasonic Doppler sensor and a fluid identification probe. Like numbered items are as described with respect to FIGS. 5 and 6. The sensor package 502 has a mounting block 604 and 606 at each end. The mounting blocks 604 and 606 have differences in construction for connection and assembly. In some embodiments, the mounting blocks 604 and 606 are differently shaped to match indentations in a particular direction. The different shapes for the mounting block 604 and 606 may be used to align the sensor package 502 in a correct direction along the instrumented mandrel, for example, aligning the sensors in the direction of flow. As described herein, the mounting blocks 604 and 606 are attached to the mandrel using recessed screws 702.

The sensor package 502 is encased in three tubular portions forming a high pressure housing. A lower body 704 joins to the first mounting block 604, through which electrical connections are passed, for example, using a monopin connector 706, available in the Kemtite series, from Kemlon Products of Pearland, Tex. The monopin connector provides a single sealed connection, for example, for a serial data bus, passing through the mounting block 604. The tubular portions may be used as a ground or second conductor. In this embodiment, the lower body 704 contains an electronics package 708, which may provide processing and storage for the fluid identification probe 710, the ultrasonic Doppler sensor 712, or both. The electronics package 708 is discussed in further detail with respect to FIG. 11. Another monopin connector may be mounted in the second mounting block 606 to allow connections to other equipment, for example, providing a serial bus to other sensor packages 502 of the instrumented mandrel.

A sensor housing 714 provides contact between the sensors and the fluids outside of the sensor housing. Specifically, a notch 716 in the sensor housing 714 allows the fluid identification probe 710 and the ultrasonic Doppler sensor 712 to measure the fluids outside of the sensor housing 714 while protecting the sensors from impacts and other hazards. The notch 716 may be shaped as a semicircle with the ultrasonic Doppler sensor 712 mounted along an upper portion of the curve surface at one end and the fluid identification probe 710 extending out from the curve surface at the opposite end. In various embodiments, the notch 716 is between about 30 mm and about 70 mm in length, or about 50 mm in length. In various embodiments, the notch 716 is between about 5 mm in width and about 10 mm in width, or about 7.5 mm in width.

An upper housing 718 connects to the sensor housing 714, and holds other units such as, for example, a battery, communications units, and the like. The upper housing couples to the second mounting block 606.

Figure 8:
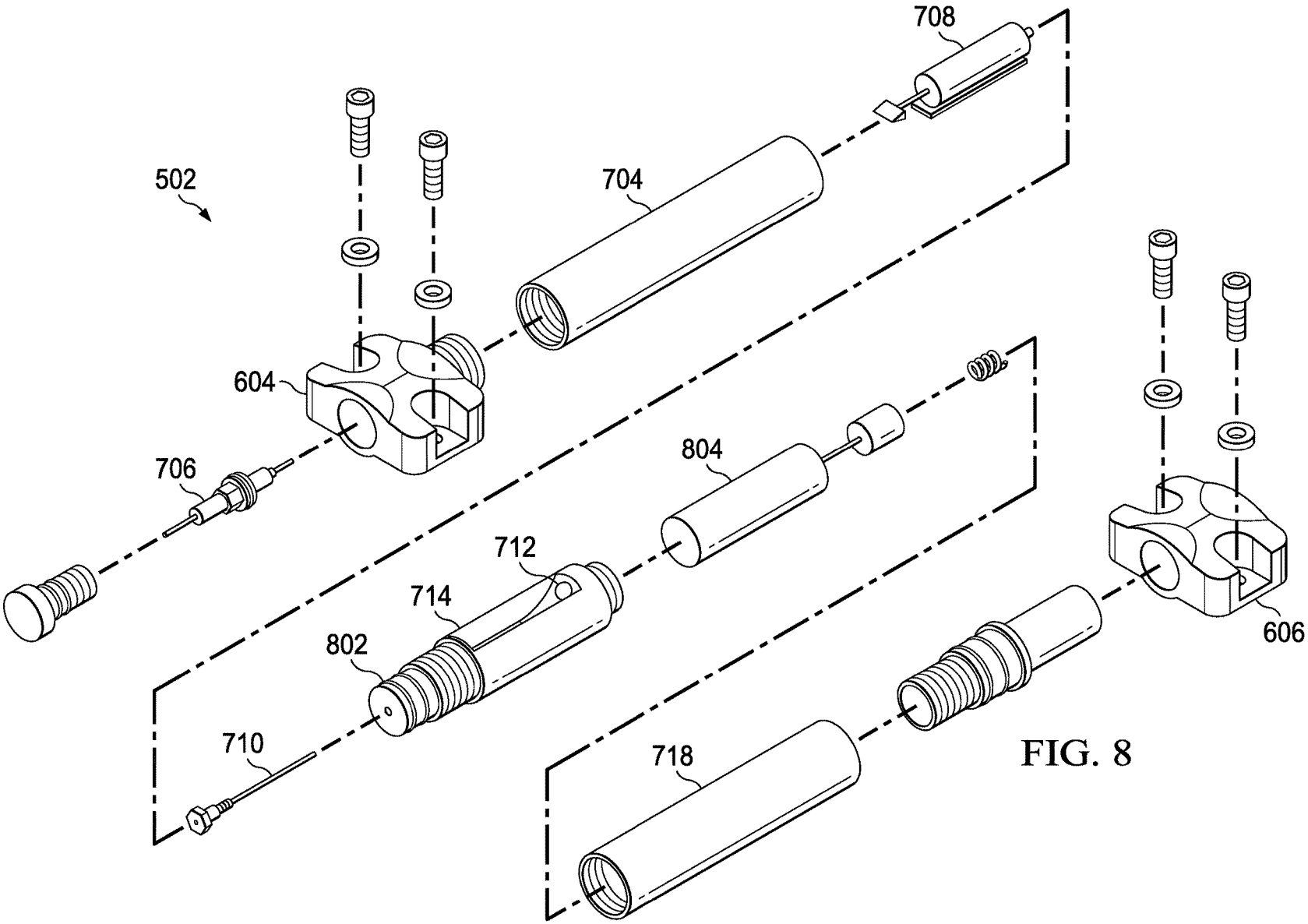
FIG. 8 is a drawing of the sensor package disassembled to show the individual parts.

FIG. 8 is a drawing of the sensor package 502 disassembled to show the individual parts. Like numbered items are as described with respect to FIG. 7. As shown in FIG. 8, each of the parts of the sensor package 502 slide together and into the tubular portions 704, 714, and 718 of the high pressure housing. Each of the tubular portions 704, 714, and 718 are threaded to connect to adjoining portions, and O-ring seals 802 are included to prevent leakage of fluids into the sensor packages 502. In the drawing of FIG. 8, a battery 804 is visible. In some embodiments, the battery 804 is a lithium ion battery. Each of the sensor packages 502 along the instrumented mandrel may include a battery 804, such as a lithium ion battery. If a wireline connects the instrumented mandrel to the surface, a power cable may be included to charge the battery 804. If no wireline is present, the battery 804 may be replaced when the coil tubing is pulled from the wellbore.

In some embodiments, the fluid identification probe 710 is an optical probe, for example, measuring absorbance or fluorescence at particular wavelengths. In some embodiments, the fluid identification probe 710 is a conductance probe, for example, measuring the conductivity of the solution to determine the ratio of hydrocarbon to water. Although the sensor packages 502 that are described with respect to FIGS. 7 and 8 include the ultrasonic Doppler sensor and the fluid identification probe, any number of other sensors may be included in a sensor package in addition to, or instead of, these sensors.

Figure 9:
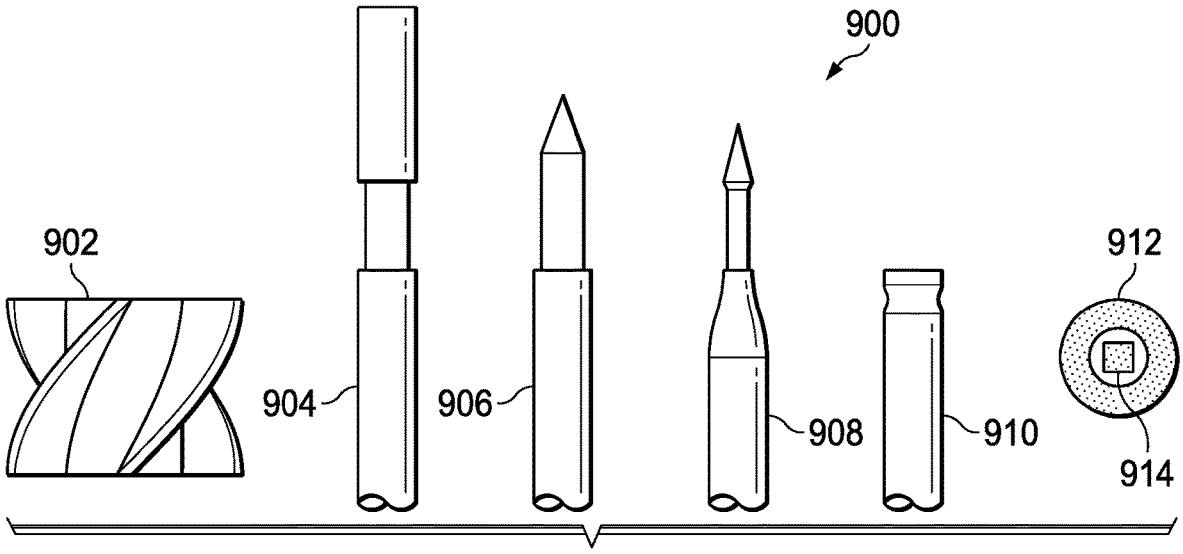
FIG. 9 is a drawing of individual sensors that may be used in a sensor package.

FIG. 9 is a drawing 900 of individual sensors that may be used in a sensor package. The sensors may include a micro spinner 902 for sensing flow, for example, by measuring the rate of the spinning through electrical or magnetic detection. In various embodiments, the micro spinner 902 is between about 3 mm in diameter and 7 mm in diameter, or about 5 mm in diameter. A high-resolution temperature probe 904 may be used for measuring the temperature of the fluids flowing past the instrumented mandrel in the annulus of the wellbore. An electrical probe 906 may be used to measure the water content, and other parameters, of the fluids. For example, this may be performed by determining the conductivity of the fluids, or the changes in the conductivity the fluids, among other properties. An optical probe 908 may be included to determine materials present, for example, by absorbance or fluorescence spectroscopy. The optical probe 908 may be used to measure other properties, such as light scattering to determine particle content or bubble content, among others. And ultrasonic probe 910 may be used to determine the speed of the flow through ultrasonic Doppler measurements, as described herein. In various embodiments, the sensors 904, 906, 908, and 910 are between about 1 mm in diameter and 3 mm in diameter, or about 1.5 mm in diameter.

A microelectromechanical system (MEMS) pressure sensor 912 may be used to determine the pressure in the wellbore. The MEMS pressure sensor 912 shown in FIG. 9 is an enlarged view of the tip of the sensor, showing the MEMS device 914 used for the pressure measurement. The MEMS pressure sensor 912 would be mounted at the tip of the probe with a similar form factor to the high-resolution temperature probe 904.

The combination of sensors used to form the sensor packages depends on the configuration of the instrumented mandrel and the expected conditions in the wellbore. Multiple different types of sensors in different sensor packages may be used for determining the data needed for geosteering.

Figure 10A:
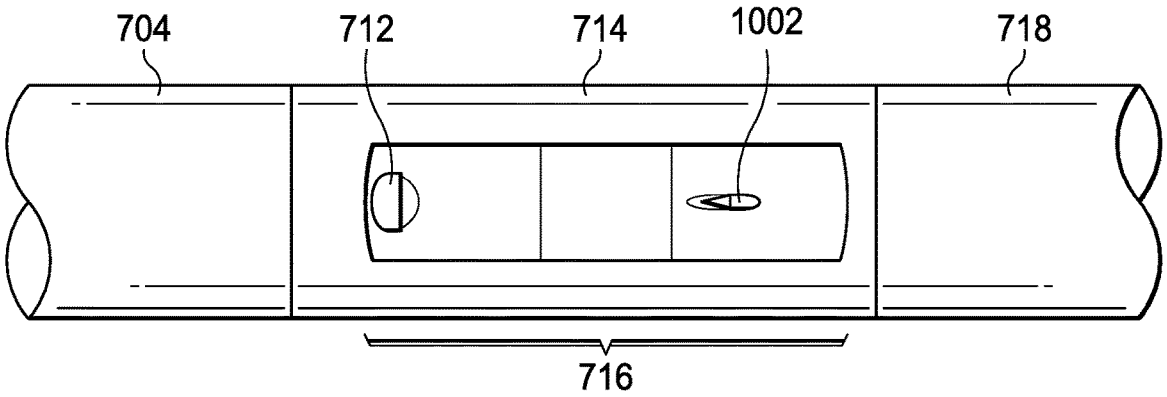
FIGS. 10A and B are close-up views of sensor packages, illustrating the positioning of sensors in a slot in the outside of the sensor housing.
Figure 10B:
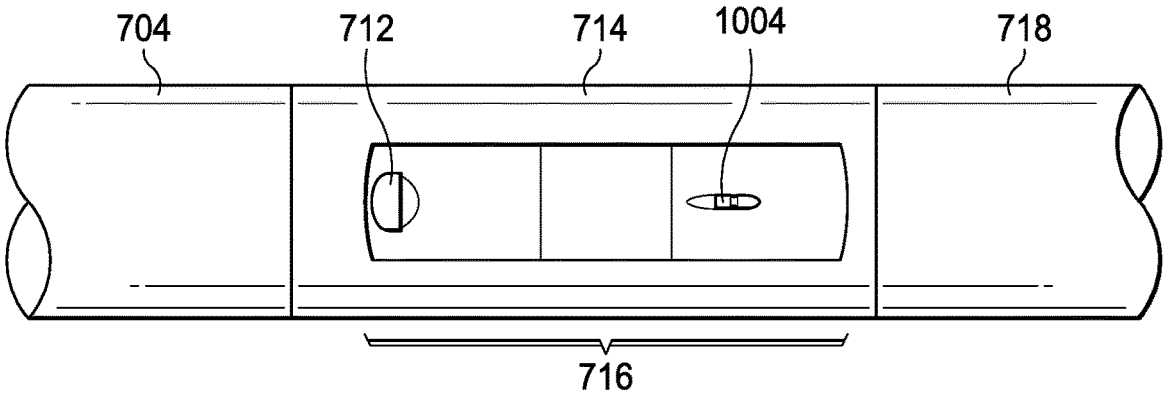

FIGS. 10A and B are close-up views of sensor packages, illustrating the positioning of sensors 712, 1002, and 1004 in the notch 716 in the outside of the sensor housing 714. Like numbers are as described with respect to FIG. 7. In FIG. 10A, the ultrasonic Doppler sensor 712 is mounted in the notch 716 opposite an electrical probe 1002. In FIG. 10B, the ultrasonic Doppler sensor 712 is mounted in the notch 716 opposite an optical probe 1004.

Figure 11:
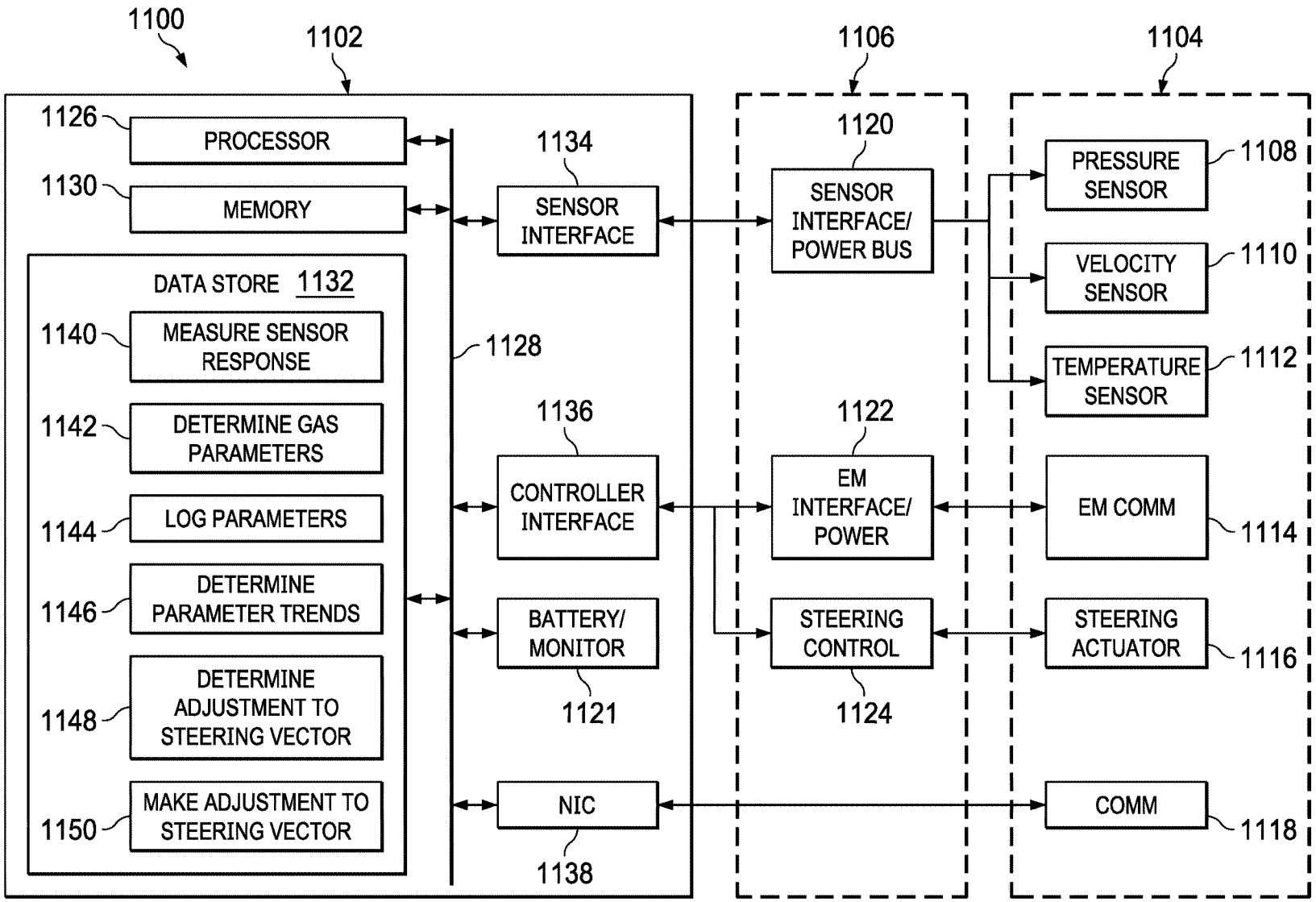
FIG. 11 is a block diagram of a system that may be used for geosteering a BHA based, at least in part, on data from parameters measured by sensors deployed in a sensor package mounted on an instrumented mandrel.

FIG. 11 is a block diagram of a system 1100 that may be used for geosteering a BHA based, at least in part, on data from parameters measured by sensors deployed in a sensor package mounted on an instrumented mandrel. In some embodiments, at least a part of the system 1100 is included in the electronics package, described with respect to FIGS. 7 and 8. The system 1100 includes a controller 1102 and BHA sensors/actuators 1104 that are coupled to the controller 1102 through a number of sensor interfaces 1106. In the embodiment shown in FIG. 11 the BHA sensors/actuators 1104 include a pressure sensor 1108, a velocity sensor 1110, and a temperature sensor 1112. As described herein, the pressure sensor 1108 may be a MEMS sensor. The velocity sensor 1110 may be an ultrasonic based Doppler sensor. The temperature sensor 1112 may be high-resolution temperature probe.

In addition, the BHA sensors/actuators 1104 may include an electromagnetic (EM) communications device 1114, for example, used to communicate between instrumented mandrels. The EM communications device 1114 may also be used for sensing the presence of water proximate to the BHA, for example, by detecting a decrease in signal strength at the receiving mandrel from the broadcasting mandrel. Further, in some embodiments, multiple antennas may be spaced around the instrumented mandrels providing directional determination of the water proximate to the BHA.

A steering actuator 1116 may be a mud motor, hydraulic actuator, or other device used to redirect the drillbit. A communicator 1118 may be included in the BHA sensors/actuators 1104 to allow communications with the surface. The communicator 1118 may be based on mud pulse telemetry. In some embodiments, the drilling fluid is compressed gas. In these embodiments, the communicator 1118 may not be present as the compressibility of the drilling fluid limits communications through mud pulse telemetry. In other embodiments, the communicator 1118 is a digital interface to a wireline or optical line coupled to equipment at the surface through the coiled tubing line.

The BHA sensors/actuators 1104 are coupled to the controller 1102 through a number of different sensor interfaces 1106. For example, a sensor interface and power bus 1120 may couple the pressure sensor 1108, the velocity sensor 1110, and the temperature sensor 1112 to the controller 1102. Further, the sensor interfaces 1106 generally provide power to the individual sensors, such as from a battery 1121 included in the controller 1102 or from a power line to the surface.

The sensor interfaces 1106 may include an electromagnetic (EM) interface and power system 1122 that provides power for the EM communications device 1114. The EM communications device 1114 may be used to provide communications between instrumented mandrels. This may allow the communicator 1118 to be located in a last mandrel, e.g., farthest from the drillbit along the BHA, allowing the last mandrel to provide communications through the communicator 1118 to the surface.

If present, the steering actuator 1116 is powered by hydraulic lines or electric lines, for example, from the surface. In some embodiments, a steering control unit 1124 provides the power or hydraulic actuation for the steering actuator 1116. In other embodiments, the geo-steering is performed by other techniques, such as the inclusion of bent subs in the BHA. In yet other embodiments, the coiled tubing drilling apparatus is pulled from the wellbore to obtain log data from the controller 1102, and determine the trajectory changes to make.

The controller 1102 may be a separate unit mounted in the control shack 116 (FIG. 1), for example, as part of a programmable logic controller (PLC), a distributed control system (DCS), or another computer control unit used for controlling the drilling. In other embodiments, the controller 1102 may be a virtual controller running on a processor in a DCS, on a virtual processor in a cloud server, or using other real or virtual processors. In one embodiment, the controller 1102 is included in an instrument package attached to the BHA, for example, in an instrumented mandrel along with sensors. This embodiment may be used with gas as the drilling fluid, as communications to the surface may be limited. Further, embedding the controller 1102 in the BHA may be used for LWD, in which the coiled tubing is pulled from the wellbore to retrieve the data.

The controller 1102 includes a processor 1126. The processor 1126 may be a microprocessor, a multi-core processor, a multithreaded processor, an ultra-low-voltage processor, an embedded processor, or a virtual processor. In some embodiments, the processor 1126 may be part of a system-on-a-chip (SoC) in which the processor 1126 and the other components of the controller 1102 are formed into a single integrated electronics package, for example, as described with respect to FIGS. 7 and 8. In various embodiments, the processor 1126 may include processors from Intel® Corporation of Santa Clara, Calif., from Advanced Micro Devices, Inc. (AMD) of Sunnyvale, Calif., or from ARM Holdings, LTD., Of Cambridge, England. Any number of other processors from other suppliers may also be used.

The processor 1126 may communicate with other components of the controller 1102 over a bus 1128. The bus 1128 may include any number of technologies, such as industry standard architecture (ISA), extended ISA (EISA), peripheral component interconnect (PCI), peripheral component interconnect extended (PCIx), PCI express (PCIe), or any number of other technologies. The bus 1128 may be a proprietary bus, for example, used in an SoC based system. Other bus technologies may be used, in addition to, or instead of, the technologies above. For example, the interface systems may include I2C buses, serial peripheral interface (SPI) buses, Fieldbus, and the like.

The bus 1128 may couple the processor 1126 to a memory 1130, such as RAM, ROM, and the like. In some embodiments, such as in PLCs and other process control units, the memory 1130 is integrated with a data store 1132 used for long-term storage of programs and data. The memory 1130 include any number of volatile and nonvolatile memory devices, such as volatile random-access memory (RAM), static random-access memory (SRAM), flash memory, and the like. In smaller devices, such as PLCs, the memory 1130 may include registers associated with the processor itself. The data store 1132 is used for the persistent storage of information, such as data, applications, operating systems, and so forth. The data store 1132 may be a nonvolatile RAM, a solid-state disk drive, or a flash drive, among others. In some embodiments, the data store 1132 will include a hard disk drive, such as a micro hard disk drive, a regular hard disk drive, or an array of hard disk drives, for example, associated with a DCS or a cloud server.

The bus 1128 couples the processor 1126 to a sensor interface 1134. The sensor interface 1134 is a data interface that couples the controller 1102 to the sensor interface and power bus 1120. In some embodiments, the sensor interface 1134 and the sensor interface and power bus 1120 are combined into a single unit, such as in a universal serial bus (USB).

The bus 1128 also couples the processor 1126 to a controller interface 1136. The controller interface 1136 may be an interface to a plant bus, such as a Fieldbus, an I2C bus, an SPI bus, and the like. The controller interface 1136 may provide the data interface to the electromagnetic interface and power system 1122.

The bus 1128 couples the processor 1126 to a network interface controller (NIC) 1138. The NIC 1138 couples the controller 1102 to the communicator 1118, for example, if the controller 1102 is located in the BHA.

The data store 1132 includes a number of blocks of code that, when executed, direct the processor to carry out the functions described herein. The data store 1132 includes a code block 1140 to instruct the processor to measure the sensor responses, for example, from the pressure sensor 1108, the velocity sensor 1110, and the temperature sensor 1112. The instructions of the code block 1140 may also instruct the processor 1126 to determine the presence of water proximate to the BHA using the EM communications device 1114.

The data store 1132 may include a code block 1142 to instruct the processor 1126 to determine parameters from the measurements As described herein, the parameters may include hydrocarbon content of flowing fluids, gas content in flowing fluids, flow velocity, and the like. The determination is made for each instrumented mandrel, if more than one is present, and a difference between the measurements for the instrumented mandrels is calculated. A code block 1144 is included to instruct the processor 1126 to determine trends in the parameters.

The data store 1132 may include a code block 1144 to log the data and parameters for transmission to a surface unit, or for later retrieval. The stored data may be kept in a non-volatile memory such as the data store itself.

The data store 1132 may include a code block 1146 to instruct the processor 1126 to determine trends in the parameters from the measurements. The trends may include changes in water concentration over time, in gas content over time, the change in distance to a water layer, and the like.

The data store 1132 may include a code block 1148 to instruct the processor 1126 to determine adjustments to the steering vector based on the measurements, trends, and geophysical data. A code block 1150 may be included to direct the processor 1126 to automatically make the adjustments to the steering vector, for example, if the drilling fluid is a gas that makes communications to the surface difficult by mud pulse telemetry.

Figure 12:
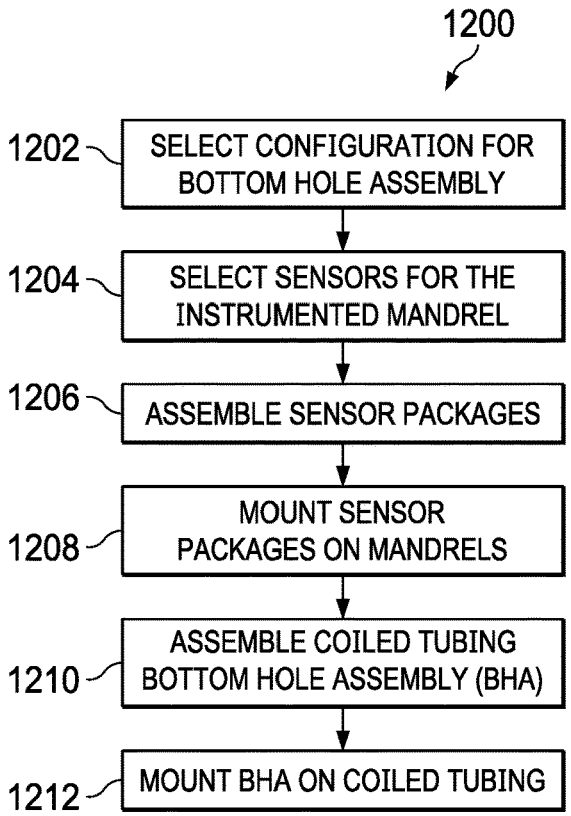
FIG. 12 is a process flow diagram of a method for assembling a bottom hole assembly that includes an instrumented mandrel that includes a sensor package for logging while drilling in coiled tubing drilling.

FIG. 12 is a process flow diagram of a method 1200 for assembling a bottom hole assembly that includes an instrumented mandrel that includes a sensor package for logging while drilling in coiled tubing drilling. The method begins at block 1202 with the selection of a configuration for the bottom hole assembly. The selection may include the number of instrumented mandrels, the separation between instrumented mandrels, and other tools that may be used in the bottom hole assembly, including, for example, the type of drill bit, telemetry tools, and the like.

At block 1204, the sensors and equipment for an instrumented mandrel may be selected. These may be based on the number and type of instrumented mandrels to be used, the downhole environment expected, the drilling fluid to be used, and the like. For example, if multiple instrumented mandrels are used, an EM communication system may be included in each instrumented mandrel to transfer data between instrumented mandrels. If a liquid drilling fluid is used and instrumented mandrel closest to the surface may include a mud pulse telemetry system to communicate data to the surface. If the drilling fluid is a compressed gas, the mud pulse telemetry system is not included. If the target hydrocarbon is natural gas, composition sensors to determine the ratio of gas bubbles to liquid may be included. If a water layer is expected to be proximate to the reservoir, conductivity probes may be included to determine the proportion of water to hydrocarbon. Any number of other sensors may be included, for example, as described with respect to FIG. 9.

Once the sensors are selected, at block 1206 the sensor packages are assembled. This may be performed by connecting the different sensors and assembling the sensor package in the lower body, sensor housing and upper body. The mounting brackets are attached and the monopin connectors are inserted into the mounting brackets.

At block 1208, the sensor package is mounted on the instrumented mandrel. This is performed by inserting the mounting brackets into the matching openings along the instrumented mandrel, wherein the sensor packet lies in the notch along the instrumented mandrel. The attachment screws are then inserted through the openings in the mounting brackets and tightened to hold the mounting brackets to the instrumented mandrel.

At block 1210, the bottom hole assembly (BHA) for the coiled tubing drilling line is assembled. This may be performed by attaching a spacer line to the first instrumented mandrel, attaching a second instrumented mandrel to the spacer line, attaching a drilling sub to the second instrumented mandrel, and attaching a telemetry package to the drilling sub. A drill bit may then be attached to the telemetry package.

At block 1212, the BHA is mounted on the coiled tubing. This may be performed in the field, allowing customization of the BHA for the drilling conditions detected.

Figure 13:
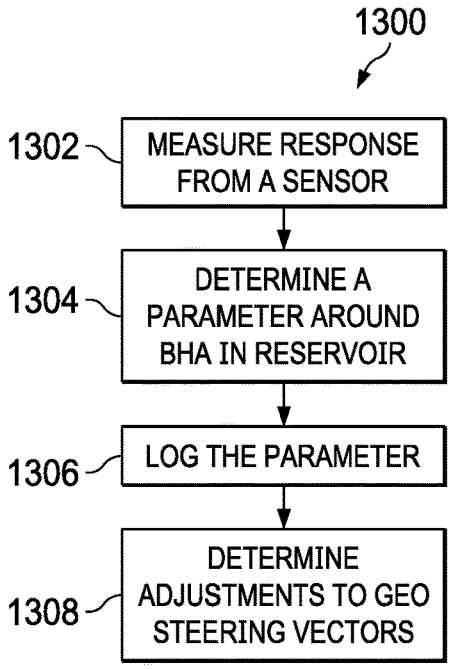
FIG. 13 is a process flow diagram of a method 1300 for using sensors for geosteering in coiled tubing drilling.

FIG. 13 is a process flow diagram of a method 1300 for using sensors for geosteering in coiled tubing drilling. The method begins at block 1302, with the measurement of a response from a sensor, for example, in a sensor package mounted to a instrumented mandrel. As described herein, the measurement may include pressure, temperature, flow velocity, the amount of gas in the liquid fraction of the produced fluids, and the presence of conductive fluids, among others. Multiple parameters may be measured by different sensors in a single sensor package and in multiple sensor packages mounted to the instrumented mandrel or multiple instrumented mandrels.

At block 1304, a parameter at the BHA is determined from the measurements. Trends in the parameters may also be determined. As the measurements are quantitative, the analysis of the data during the trajectory of the drilling of the wellbore provides the information used to determine if the wellbore is being drilled in the targeted structural layer of the reservoir.

At block 1306, the parameter is logged. This may be performed for multiple parameters, if measured. The logged parameters may be used locally, or communicated to the surface, for example, through a mud pulse telemetry device, or through a wireline. If multiple instrumented mandrels are present, the parameters may be sent to a single instrumented mandrel for logging and transmission to the surface, for example, the instrumented mandrel closest to the surface.

In some embodiments, the parameters and the trends in the parameters are integrated with a priori information of the area, including, for example, geological structural models and dynamic models of the area. The parameters and the trends in the parameters can also be used with other LWD or MWD measurements, such as resistivity, acoustic measurements, measurements from cuttings, or flow measurements at the surface, to assess if the wellbore is still being drilled into an economically productive reservoir layer.

At block 1308, adjustments to geosteering vectors are determined. The information obtained from the combination of the parameters and trends in the parameters, along with the modeling parameters, may be used to determine adjustments to the geosteering vectors. For example, the information may indicate that the wellbore needs to be steered to the right, left, up, or down.

In coiled tubing drilling, a mud motor can be used to change the direction of the drillbit, thus changing the trajectory of the wellbore. The determination of the direction to steer the drillbit is based on the tool measurements and the knowledge of the geological setting. For example, if radiofrequency (RF) sensors indicate the presence of water around the tool, this indicates that the BHA is proximate to the lower layer 112 (FIG. 1), or water aquifer, indicating that steering the drillbit upward away from the water will increase the percentage of the hydrocarbon produced.

In some embodiments, the information may indicate that the wellbore has left the productive zone. In some embodiments, the coil tubing is removed to allow a completely different direction to be drilled. In other embodiments, leaving the productive zone indicates that the drilling is completed, and further well completion activities may be performed to begin production, such as fracturing the rock around the well environment, positioning of production tubing in the wellbore, and the like.

An embodiment described herein provides a system for measuring parameters while drilling a wellbore using a coiled tubing drilling apparatus. The system includes an instrumented mandrel including a notch in an outer surface of the instrumented mandrel, and an indentation at each end of the notch. A sensor package in the system includes a sensor, a tubular assembly, and a mounting bracket at each end of the tubular assembly. The sensor package is sized to fit in the notch, with each of the mounting brackets fitting in one of the indentations at each end of the knot, and wherein the sensor package is substantially flush with the instrumented mandrel.

In an aspect, the system further includes a bottom hole assembly including at least two instrumented mandrels, and a drillbit. In an aspect, the system includes an electromagnetic communication device mounted on each of the at least two instrumented mandrels, wherein the electromagnetic communication device provides radiofrequency communications between the at least two instrumented mandrels.

In an aspect, the system includes a sealed surface system to allow the coiled tubing drilling apparatus to drill in an underbalanced configuration.

In an aspect, the system includes a pressure sensor. In an aspect, micro-electromechanical system (MEMS) sensor.

In an aspect, the system includes a velocity sensor. In an aspect, the velocity sensor includes a Doppler system, including an ultrasonic transducer and an ultrasonic detector. In an aspect, the system includes a temperature sensor. In an aspect, the system includes a conductivity probe.

In an aspect, the system includes an electromagnetic communications device. In an aspect, the system includes a mud pulse telemetry system. In an aspect, the system includes a steering actuator to change a direction of the wellbore.

In an aspect, the system includes a controller, wherein the controller includes a processor and a data store. The data store includes instructions that, when executed, direct the processor to measure a response from the sensor, determine a parameter from the response, and log the parameter.

In an aspect, the data store includes instructions that, when executed, direct the processor to measure a signal-to-noise ratio for radiofrequency communications with another instrumented mandrel. In an aspect, the data store comprises instructions that, when executed, direct the processor to use the measurement of the signal-to-noise ratio to determine a distance to water in the wellbore.

In an aspect, the data store includes instructions that, when executed, direct the processor to determine a trend in the parameter and determine an adjustment to a steering vector based, at least in part, on the parameter, the trend in the parameter, or both. In an aspect, the data store comprises instructions that, when executed, direct the processor to make adjustments to the steering vector.

Another embodiment described herein provides a method for assembling a bottom hole assembly for coiled tubing drilling that includes an instrumented mandrel. The method includes selecting a configuration for the bottom hole assembly, selecting a sensor, assembling a sensor package, and mounting the sensor package on the instrumented mandrel. The bottom hole assembly for the coiled tubing drilling is assembled and mounted on a coiled tubing apparatus.

In an aspect, selecting the configuration for the bottom hole assembly includes selecting at least two instrumented mandrels to be included in the bottom hole assembly and equipping each of the at least two instrumented mandrels with an electromagnetic communication system for radiofrequency communications between the at least two instrumented mandrels.

In an aspect, the method includes selecting a separation distance between the at least two instrumented mandrels. In an aspect, the method comprises equipping the instrumented mandrel of the at least two instrumented mandrels located furthest from a drillbit with a mud pulse telemetry communicator. In an aspect, equipping the instrumented mandrel of the at least two instrumented mandrels that is located furthest from a drillbit with a wireline communication system.

Another embodiment described herein provides a method for geosteering a wellbore using an instrumented mandrel in a bottom hole assembly on a coiled tubing drilling apparatus. The method includes measuring a response from a sensor disposed in a sensor package on the instrumented mandrel in the bottom hole assembly, determining a parameter from the response, and logging the parameter. Adjustments to geosteering vectors for the bottom hole assembly are determined based on the parameter.

In an aspect, the method includes drilling a wellbore in an underbalanced condition using the coiled tubing drilling apparatus.

In an aspect, the method includes measuring a response from a sensor disposed in a sensor package on a second instrumented mandrel in the bottom hole assembly and determining a second parameter from the measurement on the second instrumented mandrel. In an aspect, the method includes communicating the second parameter from the second instrumented mandrel to the instrumented mandrel.

In an aspect, the method includes measuring temperature. In an aspect, the method includes measuring a hydrocarbon content in a two phase stream. In an aspect, the method includes measuring a gas content in a two-phase stream. In an aspect, the method includes measuring flow velocity. In an aspect, the method includes measuring pressure.

In an aspect, the method includes measuring a signal-to-noise ratio for a radio frequency communication between two instrumented mandrels and determining a distance to water from at least one of the two instrumented mandrels, based, at least in part, on the signal-to-noise ratio.

Other implementations are also within the scope of the following claims.

What is claimed is:

1. A system for measuring parameters while drilling a wellbore using a coiled tubing drilling apparatus, comprising at least two instrumented mandrels, each comprising:

a sensor package, comprising an electromagnetic communication device; and a controller, wherein the controller comprises:

a processor; and a data store, wherein the data store comprises instructions that, when executed, direct the processor to measure a signal-to-noise ratio for radiofrequency communications with another instrumented mandrel.

2. The system of claim 1, further comprising a bottom hole assembly comprising a drill bit.

3. The system of claim 2, wherein the electromagnetic communication device on each of the at least two instrumented mandrels provides radiofrequency communications between the at least two instrumented mandrels.

4. The system of claim 1, further comprising a sealed surface system to allow the coiled tubing drilling apparatus to drill in an underbalanced configuration.

5. The system of claim 1, further comprising a pressure sensor.

6. The system of claim 5, wherein the pressure sensor comprises a micro electro mechanical system (MEMS) sensor.

7. The system of claim 1, further comprising a velocity sensor.

8. The system of claim 7, wherein the velocity sensor comprises a Doppler system, comprising an ultrasonic transducer and an ultrasonic detector.

9. The system of claim 1, further comprising a temperature sensor.

10. The system of claim 1, further comprising a conductivity probe.

11. The system of claim 1, further comprising an electromagnetic communications device.

12. The system of claim 1, further comprising a mud pulse telemetry system.

13. The system of claim 1, further comprising a steering actuator to change a direction of the wellbore.

14. The system of claim 1, further comprising a controller, wherein the controller comprises:

a processor; and a data store, wherein the data store comprises instructions that, when executed, direct the processor to:

measure a response from the sensor;

determine a parameter from the response; and log the parameter.

15. The system of claim 14, wherein the data store comprises instructions that, when executed, direct the processor to:

determine a trend in the parameter; and determine an adjustment to a steering vector based, at least in part, on the parameter, the trend in the parameter, or both.

16. The system of claim 15, wherein the data store comprises instructions that, when executed, direct the processor to make adjustments to the steering vector.

17. The system of claim 1, wherein the data store comprises instructions that, when executed, direct the processor to use the measurement of the signal-to-noise ratio to determine a distance to water in the wellbore.

18. A method for assembling a bottom hole assembly for coiled tubing drilling that includes at least two instrumented mandrels, comprising:

selecting a configuration for the bottom hole assembly;

selecting a sensor for each of the instrumented mandrels, wherein the sensor comprises an electromagnetic communication device;

assembling a sensor package for each of the instrumented mandrels, wherein the sensor package comprises a controller, wherein the controller comprises:

a processor; and a data store, wherein the data store comprises instructions that, when executed, direct the processor to measure a signal-to-noise ratio for radiofrequency communications with another instrumented mandrel;

mounting the sensor package on each of the instrumented mandrels;

assembling the bottom hole assembly for the coiled tubing drilling; and mounting the bottom hole assembly on a coiled tubing apparatus.

19. The method of claim 18, further comprising selecting a separation distance between the at least two instrumented mandrels.

20. The method of claim 18, further comprising equipping the instrumented mandrel of the at least two instrumented mandrels located furthest from a drillbit with a mud pulse telemetry communicator.

21. The method of claim 18, further comprising equipping the instrumented mandrel of the at least two instrumented mandrels that is located furthest from a drillbit with a wireline communication system.

22. A method for geosteering a wellbore using an instrumented mandrel in a bottom hole assembly on a coiled tubing drilling apparatus, comprising:

measuring a signal-to-noise ratio for electromagnetic communications with another instrumented mandrel;

determining a parameter from the signal-to-noise ratio;

logging the parameter; and determining adjustments to geosteering vectors for the bottom hole assembly based on the parameter.

23. The method of claim 22, further comprising drilling a wellbore in an underbalanced condition using the coiled tubing drilling apparatus.

24. The method of claim 22, further comprising:

measuring a response from a sensor disposed in a sensor package on a second instrumented mandrel in the bottom hole assembly; and determining a second parameter from the measurement on the second instrumented mandrel.

25. The method of claim 24, further comprising communicating the second parameter from the second instrumented mandrel to the instrumented mandrel.

26. The method of claim 22, further comprising measuring temperature.

27. The method of claim 22, further comprising measuring a hydrocarbon content in a two phase stream.

28. The method of claim 22, further comprising measuring a gas content in a two-phase stream.

29. The method of claim 22, further comprising measuring flow velocity.

30. The method of claim 22, further comprising measuring pressure.

31. The method of claim 22, further comprising determining a distance to water from at least one of the two instrumented mandrels, based, at least in part, on the signal-to-noise ratio.

* * * * *